US010354494B2

(12) United States Patent
Hartl

(10) Patent No.: US 10,354,494 B2
(45) Date of Patent: Jul. 16, 2019

(54) GAMING SYSTEM AND METHOD HAVING A PRACTICE ROUND

(71) Applicant: ADP GAUSELMANN GMBH, Espelkamp (DE)

(72) Inventor: Josef Alexander Hartl, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/006,681

(22) Filed: Jun. 12, 2018

(65) Prior Publication Data

US 2019/0102996 A1 Apr. 4, 2019

Related U.S. Application Data

(60) Provisional application No. 62/567,217, filed on Oct. 2, 2017.

(51) Int. Cl.
*A63F 9/00* (2006.01)
*G07F 17/32* (2006.01)

(52) U.S. Cl.
CPC ..... *G07F 17/3267* (2013.01); *G07F 17/3244* (2013.01)

(58) Field of Classification Search
None
See application file for complete search history.

(56) References Cited

U.S. PATENT DOCUMENTS 5,267,734 A * 12/1993 Stamper ..... A63F 13/10 273/148 B
7,722,456 B2 * 5/2010 Walker ..... G07F 17/3244 463/16
8,684,830 B1 * 4/2014 Chun ..... G07F 17/322 463/25
8,808,077 B1 * 8/2014 Chun ..... G07F 17/3293 463/11
9,600,976 B2 * 3/2017 Nguyen ..... G07F 17/3288
9,666,024 B2 * 5/2017 Chun ..... G07F 17/322
2005/0288091 A1 * 12/2005 Akiyama ..... G07F 17/3202 463/20
2006/0258422 A1 * 11/2006 Walker ..... G07F 17/32 463/7
2007/0060283 A1 * 3/2007 Okada ..... G07F 17/3244 463/17
2008/0108426 A1 * 5/2008 Nguyen ..... G07F 17/32 463/25

(Continued)

*Primary Examiner* — Seng Heng Lim
(74) *Attorney, Agent, or Firm* — Resolute Legal PLLC

(57) ABSTRACT

The gaming system and method includes a game that can be played in a first game state or a second game state with the possibility of different awards for each game state. The first game state enables a player to play the game and receive a first award. The first award may be a predetermined award and not based on the outcome the game in first game state. In some embodiments, the first award is not based on how well a player played a game. The second game state enables the player to play the game and receive a second award based on the outcome of the game in the second game state. In some embodiments, the second game state enables the player to play the game and receive a second award based on how well the player played the game in the second game state.

20 Claims, 12 Drawing Sheets

(56) References Cited

U.S. PATENT DOCUMENTS

2008/0171599 A1* 7/2008 Salo ..... A63F 13/12 463/41
2009/0280910 A1* 11/2009 Gagner ..... G07F 17/32 463/42
2012/0122552 A1* 5/2012 Youm ..... A63F 13/77 463/23
2012/0178514 A1* 7/2012 Schulzke ..... G07F 17/3244 463/17
2014/0012652 A1* 1/2014 Levin ..... G06Q 30/0233 705/14.31
2014/0274342 A1* 9/2014 Nguyen ..... G07F 17/3288 463/25
2015/0141112 A1* 5/2015 McDermott ..... G07F 17/34 463/20
2015/0332537 A1* 11/2015 Chun ..... G07F 17/3293 463/25
2016/0343211 A1* 11/2016 Graboyes Goldman ..... G07F 17/3295
2018/0075707 A1* 3/2018 Hirai ..... G07F 17/3209

* cited by examiner

GAMING SYSTEM AND METHOD HAVING A PRACTICE ROUND

CROSS REFERENCE TO RELATED APPLICATION

This application claims priority to U.S. Provisional Application No. 62/567,217, filed on Oct. 2, 2017, the contents of which are hereby incorporated by reference.

FIELD OF THE INVENTION

The present disclosure relates to gaming devices.

BACKGROUND OF THE INVENTION

Gaming machines that accept wagers in exchange for the opportunity to win awards or prizes are known. Game machines that offer new ways to win awards or prizes are needed to gain and retain players' interest in the gaming machines.

SUMMARY OF THE INVENTION

Various embodiments of a gaming system and method are disclosed as having a game that can be played in a first game state or a second game state with the possibility of different awards for each game state. The first game state enables a player to play the game and receive a first award. The first award may be a predetermined award and not based on the outcome the game in first game state. In some embodiments, the first award is dynamically generated based on prior game awards. The second game state enables the player to play the game and receive a second award based on the outcome of the game in the second game state.

In one embodiment of the gaming system and method having a game that can be played in a first game state or a second game state, a player may select between the first game state or the second game state. The player may select between the first game state or the second game state before or after placing a wager on the game system. In one embodiment, the first game state is a practice game and the second game state is the game without practice game features (e.g., the game played in a normal or standard mode).

If the player selects to play the game in the first game state, the gaming system enables the player to play the game as a practice game. In one embodiment, the practice game is the same as the game of the second game state, but the gaming system provides help to the player on how to play the practice game. The help may include showing the player how to play the practice game. The help may also include providing the player with tips during a play of the practice game. The practice game enables the player to gain skill and confidence playing the practice game, which will translate into skill and confidence playing the game. In one embodiment, a player may receive a first award for a play of the practice game. In one embodiment, the first award is a guaranteed award. In one embodiment, the first award is less than an award the player could have received when playing the game. In one embodiment, the first award is a nominal value. In one embodiment, by selecting and playing the practice game, the gaming system may provide the first award to the player regardless of the outcome of the practice game. In one embodiment, where the practice game played is a game of skill, by selecting and playing the practice game, the gaming system may provide the first award to the player regardless of the player's skill level in the practice game and regardless of the outcome of the practice game. Thus, it should be appreciated that the practice game allows the player to become accustomed to a game while lowering the potential award and award volatility for the player. In still other embodiments, the first award is based on awards the gaming system previously provided to the player, other previous players, or a combination of both. In one such embodiment, the first award is based on an observed average payout of the game. In one such embodiment, the first award is based on normalizing a difference between an observed average payout of the game and predetermined theoretical average payout of the game on the gaming system. It should also be appreciated that the award in the practice game can be any suitable amount or zero.

If the player selects to play the game in the second game state, the gaming system enables the player to play the game. In one embodiment, the game is the same as the game of the first game state, but the gaming system does not provide game help to the player on how to play the game. In one embodiment, the game may result in a second award based on an outcome of the game. In one embodiment, the second award is not a guaranteed award. In one embodiment, the second award is greater than the first award the player could have received when playing the practice game. In some embodiments where the game is a skill based game, the player may exhibit skill by operating the game and win a second award, where the second award is varied based on how well the player played the game. In one embodiment, by exhibiting skill during a play of the game, the player may substantially increase the second award amount. Thus, it should be appreciated that the game increases the award volatility over the practice game and enables the player to obtain a second award that is potentially larger than the first award from the practice game.

In some embodiments, the gaming system and method may further include a skill test for games involving skill. A gaming system with the skill test enables a player to play a skill test game to determine the player's skill level for a game. The gaming system may utilize the player's skill level to change one or more parameters of the game. In one embodiment, the gaming system may set a difficulty level of the game to easy and provide a low maximum award if the gaming system determines that the player's skill level is below average. In one embodiment, the gaming system may set a difficulty level of the game to medium and provide a medium level maximum award if the gaming system determines that the player's skill level is average. In one embodiment, the gaming system may set a difficulty level of the game to hard and provide a high maximum award if the gaming system determines that the player's skill level is above average. The gaming system may offer the skill test to the player at a predetermined point during a play of a game. In one embodiment, the player may request the skill test at any time before, during, or after a play of a game. In some embodiments, the player can take the skill test without placing a wager on a game or without providing any value to a gaming system. In some embodiments, the skill test can be performed remote from the gaming system, such as through a website or an online portal. In such embodiments, skill test results can be stored and used in future games.

It should be appreciated that in some embodiments, a gaming system and method that includes practice rounds enables players unfamiliar with a game or with low game skills to play certain games without a risk or with a lower risk. In some embodiments, the gaming system and method enables players to increase their game skills through practice.

DETAILED DESCRIPTION OF THE INVENTION

Various embodiments of a gaming system and method are disclosed as having a game that can be played in a first game state or a second game state with the possibility of different awards for each game state. The first game state enables a player to play the game and receive a first award. The first award may be a predetermined award and not based on the outcome the game in first game state. The second game state enables the player to play the game and receive a second award based on the outcome of the game in the second game state.

In one embodiment of the gaming system, a game can be played as a practice game or a standard game. In other embodiments, the gaming system includes a base game and a bonus game. In one such embodiment, the bonus game can be played as a practice bonus game or standard bonus game. In other embodiments, the gaming system may evaluate a player's skill level, where the skill level can alter various attributes of a game.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

Figure 1:
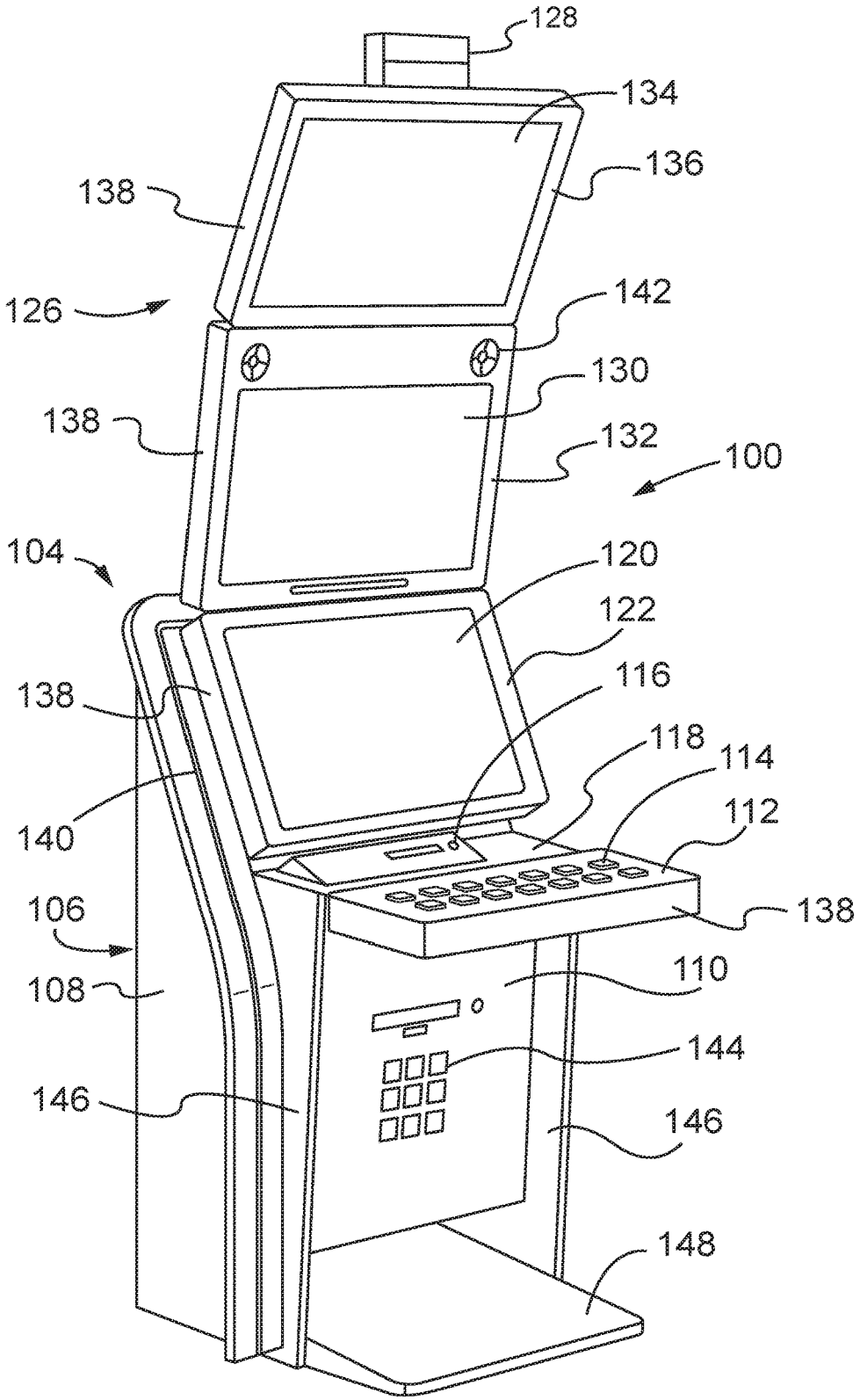
FIG. 1 is a perspective view of one embodiment of a stand-alone gaming device of a gaming system.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
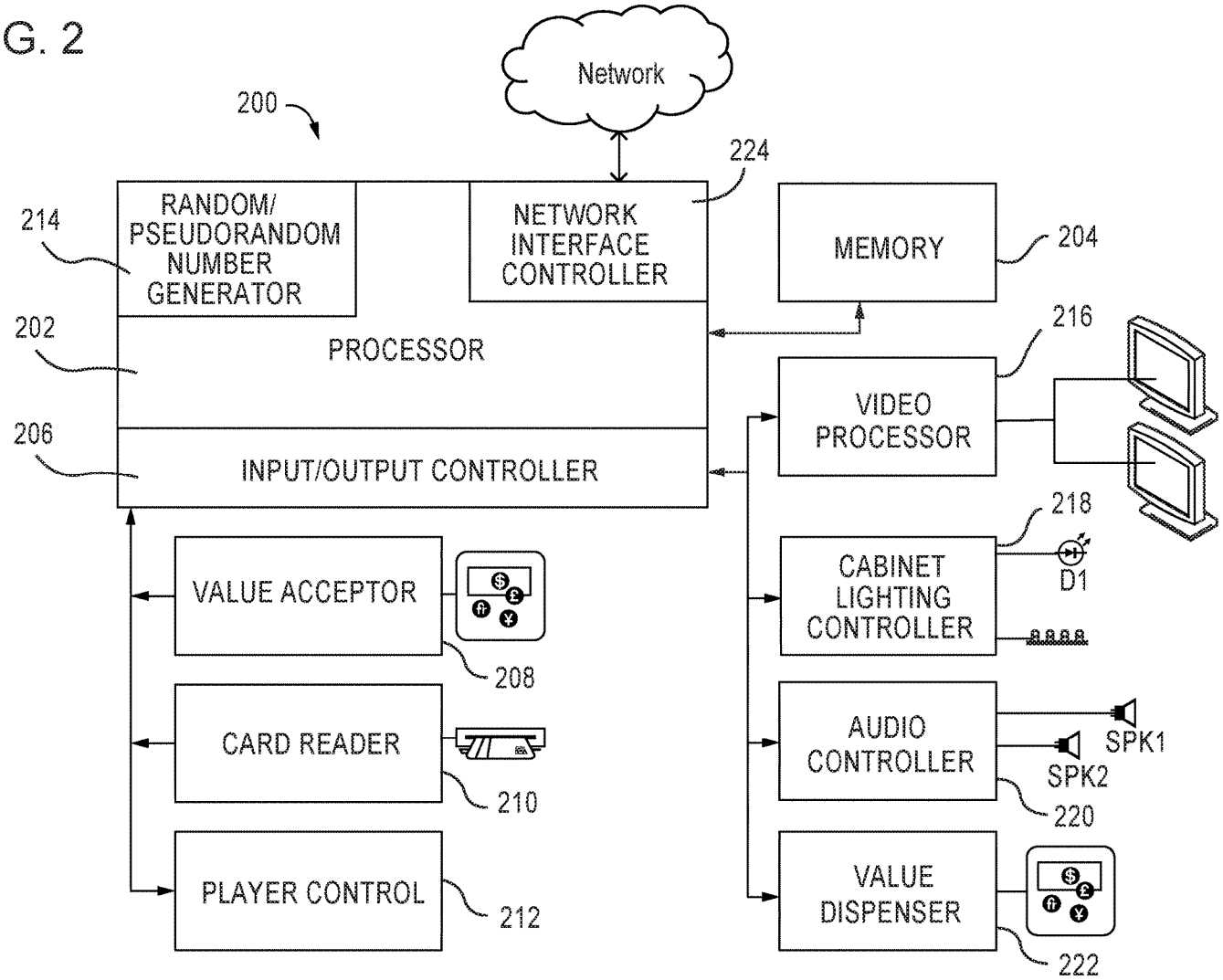
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents.

Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Game Including a Practice Round

Figure 3A:
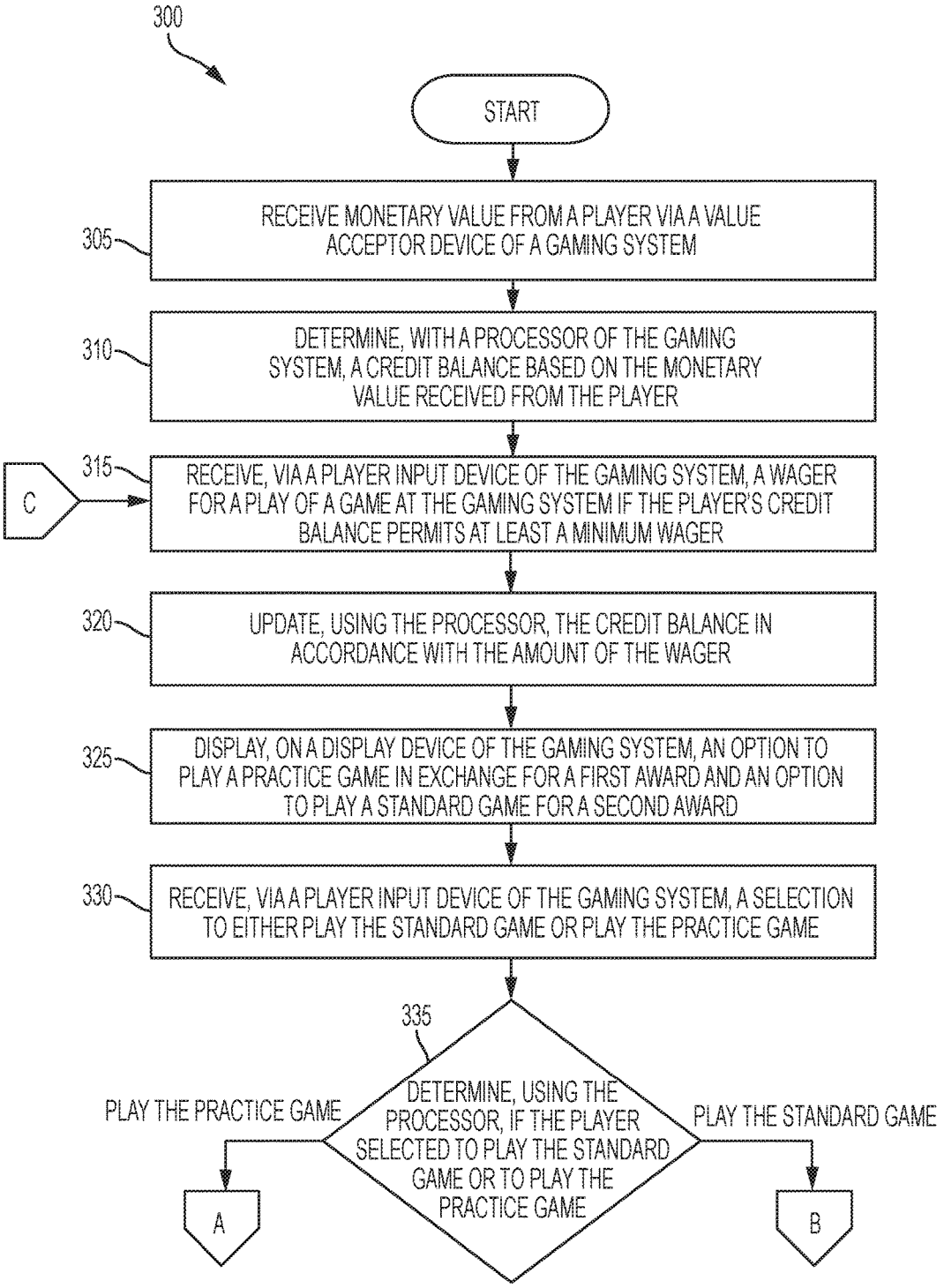
FIGS. 3A and 3B illustrate a flow chart of a game having a practice round.
Figure 3B:
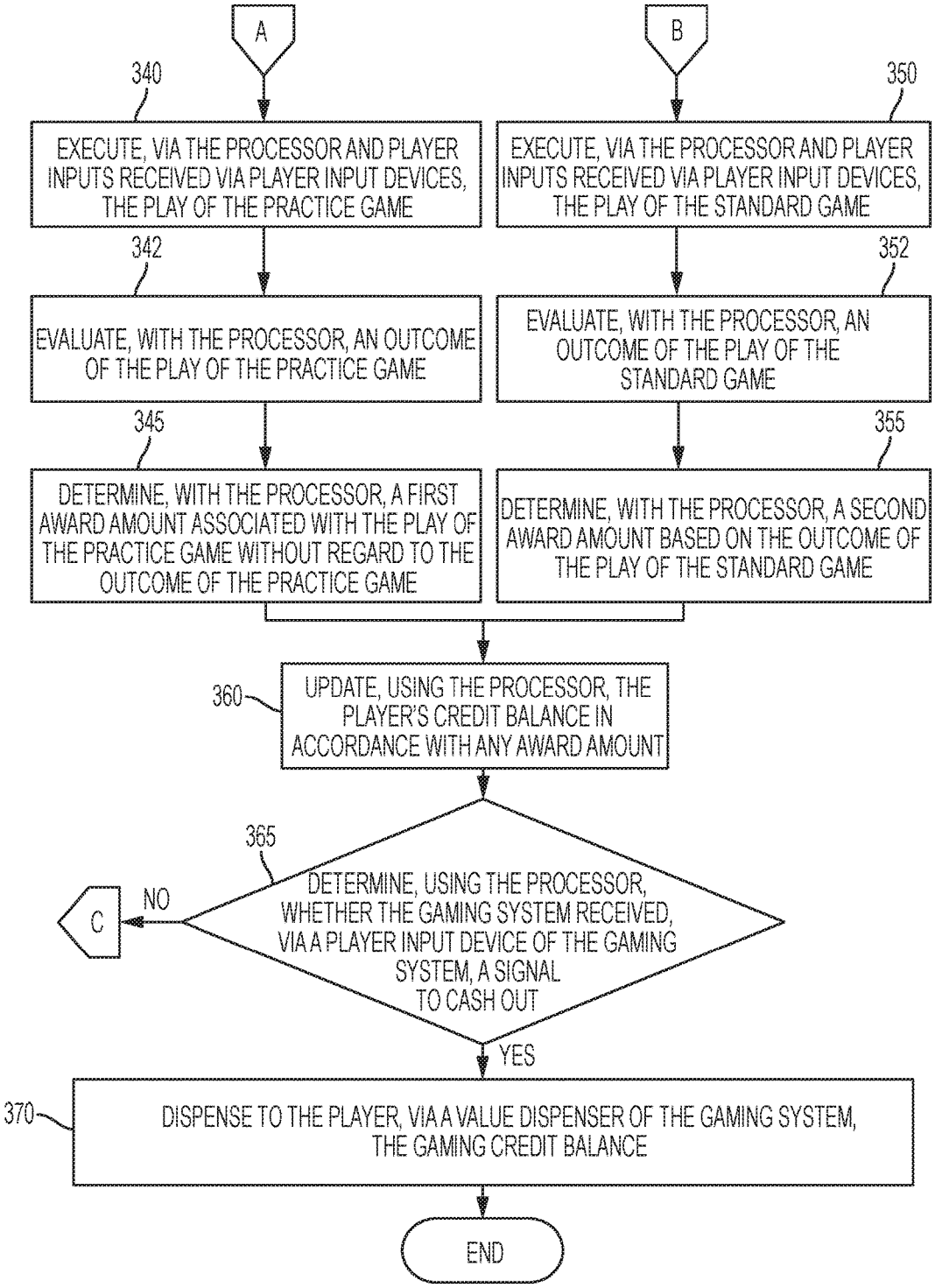

FIGS. 3A and 3B illustrate a flowchart of an example operation 300 of one embodiment of the gaming system and method. In one embodiment, at least one processor of the gaming system is configured, via instructions stored in a non-transitory memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device may be, in one embodiment, disposed in a gaming device or in communication with the gaming device as discussed above.

In one embodiment, the gaming system may determine a credit balance based on the monetary value received from the player at the value acceptor device as indicated in block 310. The gaming system may increase, via the processor, the credit balance for the player as a result of the received monetary value.

In one embodiment, the gaming system receives a wager for a play of a game at the gaming system. Block 315 of FIG. 3A illustrates one embodiment where the player's wager may be received via a player input device of the gaming system. The gaming system enables the player to place a wager for a play of a game at the gaming system. In one embodiment, the gaming system may determine whether the player's credit balance includes enough credits to enable the player's selected wager. The gaming system may prevent the player from placing the wager and starting a play of a game if the player's credit balance is not large enough to support the player's selected wager. If enough credits are not available in the player's credit balance, the gaming system may enable the player to insert additional value to obtain the minimum credit level or to cash out of the gaming device.

In one embodiment, the gaming system updates the credit balance. The gaming system may use the processor to update the gaming credit balance. The credit balance may be updated in accordance with the player's wager amount as indicated in block 320. Some embodiments, the credit balance is not updated until a later time.

Block 325 illustrates one embodiment where the gaming system displays, on a display device, an option to play a game in one of two different states. In one embodiment, the game can be played as a practice game for a first award or the game can be played as a standard game for a second award.

In one embodiment, the game play of the practice game is similar to the game play of the standard game. The practice game enables the player to play the game in a practice environment with a low level of risk. In one embodiment, the practice game provides an award to the player regardless or independent of the outcome of the game. In one embodiment, the practice game may provide a player with certain features that are not available in the standard game. In one embodiment, the practice game may provide help or other assistance in achieving a practice game goal. For example, the practice game may provide videos or audio explanations detailing how to play the game. The practice game may provide tips for successful play of the game. The practice game may provide the forgoing help at one or more different periods during a play of the practice game.

In one example embodiment, where the practice game is a slot based game with spinning reels, the gaming system may provide audio and video tips for each step of a play of the game. For example, after receiving wager, the gaming system may provide audio or video instructions to a player to select pay lines. The gaming system may explain how many pay lines the player can select and how to select the pay lines. The gaming system may explain to the player that more pay lines may increase the chance of obtaining a winning combination of symbols across the reels. The gaming system may also explain to the player that the number of selectable pay lines is determined based on the player's wager, while also discussing that if the player wanted to use more pay lines, the player can increase the wager in a next play of a game. In some embodiments of the practice game, the gaming system may allow the player to select any number of pay lines regardless of the wager, but explain to the player that obtaining more pay lines in the standard game would not be possible absent a larger initial wager. The gaming system may also explain to the player how the gaming system generates symbols on the reels, what the different symbols means, and how different predetermined symbol combinations along selected pay lines result in different awards. Once the player selects pay lines, the gaming system may instruct the player during the play of the game how to initiate the spin of the reels to generate the symbols for the reel. Once the gaming system generated and displayed the symbols on the reels, the gaming system may highlight or indicate each pay line to the player and show how the gaming system evaluates the generated symbol combinations along the wagered pay lines for the predetermined symbol combinations. If the gaming system determines a winning symbol combination along a wagered pay line, the gaming system may explain to the player the value of the winning symbol combination and show how the value of the winning symbol combination increases the player credit balance. It should be appreciated that in some embodiments, the practice game does not provide awards based on the practice game outcome, thus in some embodiments, showing the player how the winning symbol combination increases the player's credit balance is merely to show the player what the player would have won if the player played the same game as the standard game.

In some embodiments, the game is a game of skill and the practice game enables a player to develop the skills required for success in the standard game with a low level of risk. Like the slot based game example above, the gaming system may provide various forms of help and assistance to the player during a play of the skills based game played as a practice game. In one embodiment, the skill required for success in the standard skills based game may relate to a player's timing of input signals. The practice game may allow the player to practice timing skills. In one embodiment where the game is a driving game, the practice game environment enables the player to practice driving one or more vehicles in the driving game. In one embodiment, the practice game may enable the player to practice a card game, such as video poker or blackjack. In one embodiment, the practice game may enable the player to practice a target hitting game. It should be appreciated that any type of game utilizing player input may be implemented in the gaming system as a practice game and standard game pairing.

In one embodiment, the practice game is not a practice version of the standard game. In some embodiments, the practice game includes similar game features as the standard game and may also include game features that are different. For example, in one slot game embodiment, the practice game may include certain game symbols that are not available in the standard game. In another slot game embodiment, the practice game may include less game symbols than are available in the standard game to reduce the complexity of the slot practice game for the player. In some embodiments, the practice game and the standard game may be unrelated. In one embodiment, the practice game may allow for the practice of at least one skill that is necessary for success in the standard game while the game play in the practice game is different from the standard game.

In one embodiment, block 325 may include display of information about the practice game and information about the standard game. A general description of each game may be displayed. The general description may include information about the maximum amount of the first award available for a play of the practice game. The general description may also include information about the maximum achievable amount of the second award from a play of the standard game. Other information may be displayed about the practice game and the standard game.

In one embodiment, as illustrated in block 330, the gaming system receives the player's selection via the input device. The player may select either to play the standard game or to play the practice game. As illustrated in block 335, the gaming system determines, with the processor, if the player selected to play the practice game or to play the standard game. In one embodiment, the practice game and the standard game are the same game or substantially the same game and each may be referred to as different game states (e.g., there are at least two game states, one for the practice game and one for the standard game).

Turning to FIG. 3B and block 340, the gaming system executes, via the processor, the practice game if the gaming system determines that the player selected the option to play the practice game. In one embodiment, the practice game is executed by the processor of the gaming system. Player inputs are also received and executed by the gaming system to provide the practice game.

In one embodiment, a play of the practice game may, for example, operate more slowly than a play of the standard game. As noted above, the practice game may provide help and assistance to play the practice game. The practice game may provide information related to a skill required by a standard game. In one embodiment, the practice game may provide information regarding how to successfully achieve goals in a standard game. In one embodiment, the information may be related to successful timing of player inputs and a player may be allowed to practice input timing. In some embodiments, the gaming system may alter how the practice game is played when the gaming system determines that a player is deficient in a particular skill necessary to successfully play the practice game (and standard game). In some embodiments, the gaming system tracks the player's progress in one or more skill areas in a play of the game and make continue to offer altered future plays of the practice game until the player has improved any identified deficient skills. For example, if the player is playing a skill based baseball game on the gaming system and the player has difficulty hitting a generated curve ball, the gaming system may provide more curve balls to the player in some embodiments. In some embodiments of the skill based baseball game, the gaming system may generate slower curve balls for the player until the player can routinely hit the curve balls. The gaming system may incrementally increase the speed of the curve balls over multiple plays of the practice game as the player learns to routinely hit the curve balls thrown at newly incremented speeds.

The gaming system, using the processor, may evaluate an outcome of the play of the practice game as illustrated in block 342. In one embodiment, the evaluation may include a display indicating any practice game outcomes. In one embodiment of a chance game, the evaluation may include the gaming system displaying an indication of each winning symbol combination the player obtained. In another embodiment of a chance game, the evaluation may include the gaming system displaying an indication of each generated winning symbol combination and how the player could have obtained a greater number of winning symbol combinations if the player had wagered on additional pay lines or increased the award value for placing larger wagers on certain pay lines.

In one embodiment of a skills based practice game, the evaluation of block 342 may include the gaming system displaying an indication of one or more player skills that need improvement and could be improved with additional plays of the skills based practice game. In another embodiment of a skills based practice game, the evaluation of block 342 may include the gaming system displaying an indication that the player's skills are excellent and additional plays of the skills based practice game are unnecessary. In one embodiment, the evaluation of block 342 may include a display indicating the award amount the player would have received if the player's skills based practice game performance occurred in the standard game. In this manner, when the player sees a display of an award amount greater than the award amount received in the skills based practice game, the player is encouraged to play the standard game.

In block 345, the gaming system determines, with the processor, a first award amount associated with the play of the practice game. The gaming system may make the determination of the first award amount that is independent of the outcome of the practice game or otherwise without regard to the outcome of the practice game. In some embodiments, the first award amount is guaranteed. In some embodiments, the first award amount is predetermined or fixed. In some embodiments, the first award amount is smaller than a value that could be obtained as the second award amount in the standard game. In one embodiment, the first award amount is a nominal value. The nominal value may be, in one embodiment, a value equal to or less than the wager amount. In some embodiments, the nominal award may be a value that is less than, equal to, or greater than the wager amount. In some embodiments, the nominal value may be a fixed percentage of the player's wager. Thus, in some embodiments, the player is confident that the first award will be achieved while playing the practice game, which encourages the player to play the practice game. Thus, it should be appreciated that in some embodiments of the practice game, awards may encourage the player to play the practice game where the player is not penalized for selecting to play the practice game. In some embodiments, the award from a play of the practice game may be variable, but associated with a lower volatility, which enables the player to gain confidence through plays of the practice game and still achieve excitement and anticipation of winning an award. In some embodiments, the award from a play of the practice game may be variable and based in part on the player's skill during the practice game, but associated with a lower volatility. In some such embodiments for example, the gaming system may award nominally more or less than a predetermined award where a player exhibits exceptionally good or poor skills during a play of the practice game. In some embodiments, the gaming system provides a first portion of an award for play of the practice game that is predetermined and provides a second portion of the award for play of the practice game that is variable and can be based on how well the player plays during the practice game. In some such embodiments, the second portion of the award nominally increases the predetermined award and other embodiments where the second portion of the award nominally decreases the predetermined award. In some embodiments, the gaming system allows the player to play the practice game without placing a wager. In such games, the gaming system may not provide any award to the player for a play of a practice game. In some embodiments, the award from a play of the practice game may be equal to or higher than an award that may be provided to a play of the standard game. For example, in some embodiments, the gaming system may randomly determine an award for the practice game from a pool of awards (which may include awards equal to or greater than an award available in the standard game). In other embodiments, the gaming system enables a player to enter a play of a practice game at any time. For example, if a player is playing the standard game and the player is doing poorly in the standard game, the gaming system may offer the player a chance to switch to the practice game. In one such embodiment, when switching to the practice game, the gaming system may limit the player's award to an award similar to one of the practice game awards discussed herein. In some embodiments, where a player has placed a wager and is in a play of a practice game, the gaming system may enable the player to switch to the standard game if the player is performing well in the practice game. In one such embodiment, when the gaming system switches from a practice game to a standard game during a play of a game, the player's award opportunities may switch to the award opportunities associated with the standard game (discussed below).

Turning to block 350 of FIG. 3B, if the player selects the option to play the standard game, the gaming system executes, via the processor, the standard game. In one embodiment, the gaming system receives and executes the player's inputs in part to provide the standard game. As noted above, the standard game in some embodiments is the same or a similar game as the practice game, without the help and assistance provided in the practice game and played at a standard speed or pace.

In one embodiment, the game play of the standard game is similar to the practice game, but does not have certain features such as providing tips, help, or other assistance to the player during the game. In other embodiments, the standard game may include such tips, help, or other assistance. In one embodiment, the standard game is played at a standard speed or pace, which is faster than the speed or pace of the practice game. In some embodiments, the pace of the practice game is the same as the standard game. In some embodiments, the standard game enables the player to win awards larger than awards in the practice game. In some embodiments, the award is variable and is associated with a volatility that is larger or substantially larger than the volatility of the practice game. The gaming system may evaluate, with the processor, an outcome of the play of the standard game in some embodiments. The gaming system may evaluate, with the processor, an outcome of the play of the standard game based on how well the player played the standard game in some embodiments. In some embodiments, the award in the standard game is based upon the outcome of the play of the standard game, based on how well the player played the standard game, or a combination of both. In one embodiment, the game play of the standard game may not be similar to the practice game, but the standard game may require a skill that is practiced in the practice game.

In one embodiment, the gaming system may evaluate, with the processor, an outcome of the play of the standard game as indicated in block 352. In one embodiment of a game of chance, the gaming system may evaluate generated symbols for a play of a game and determine if winning symbol combinations were generated. In one embodiment, the standard game may require the player to manipulate game characters during a play of the game to achieve certain goals. The gaming system may capture and evaluate the player's actions for any achieved goals. In one embodiment, the standard game may require a decision-making skill, and the gaming system may evaluate decisions. It should be appreciated that any suitable variety of standard games and game evaluations are possible.

In block 355, the gaming system may determine, with the processor, the second award amount based on the outcome of the play of the standard game. In one embodiment, the second award amount is associated with a volatility that is larger or substantially larger than the volatility of the practice game. In one embodiment, a maximum value of the second award amount may be set higher than the first award amount. In one embodiment, the second award amount is variable. In one embodiment, the second award amount may include a base value and a value that the gaming system determines based on the player's performance in the play of the standard game. In another embodiment, the second award amount may be based solely on the player's performance in the play of the standard game. Thus, in some embodiments, the player is rewarded for skillful play of the standard game.

The gaming system may update, using the processor, a player's credit balance in accordance with any determined award amounts from either a play of the practice game or a play of the standard game, as illustrated in block 360. In block 365, the gaming system determines, using the processor, whether the gaming system has received a cash out signal from a player input device. When the cash out signal is received, the gaming system can dispense a value to the player via a value dispenser of the gaming device in accordance with the player's current credit balance as indicated in block 370. If the gaming system determines that no cash out signal was received, then gaming system may return to block 315 to continue the gaming session and enable to the player to place additional wagers and to either play additional practice games or standard games in additional plays of the game.

Figure 4A:
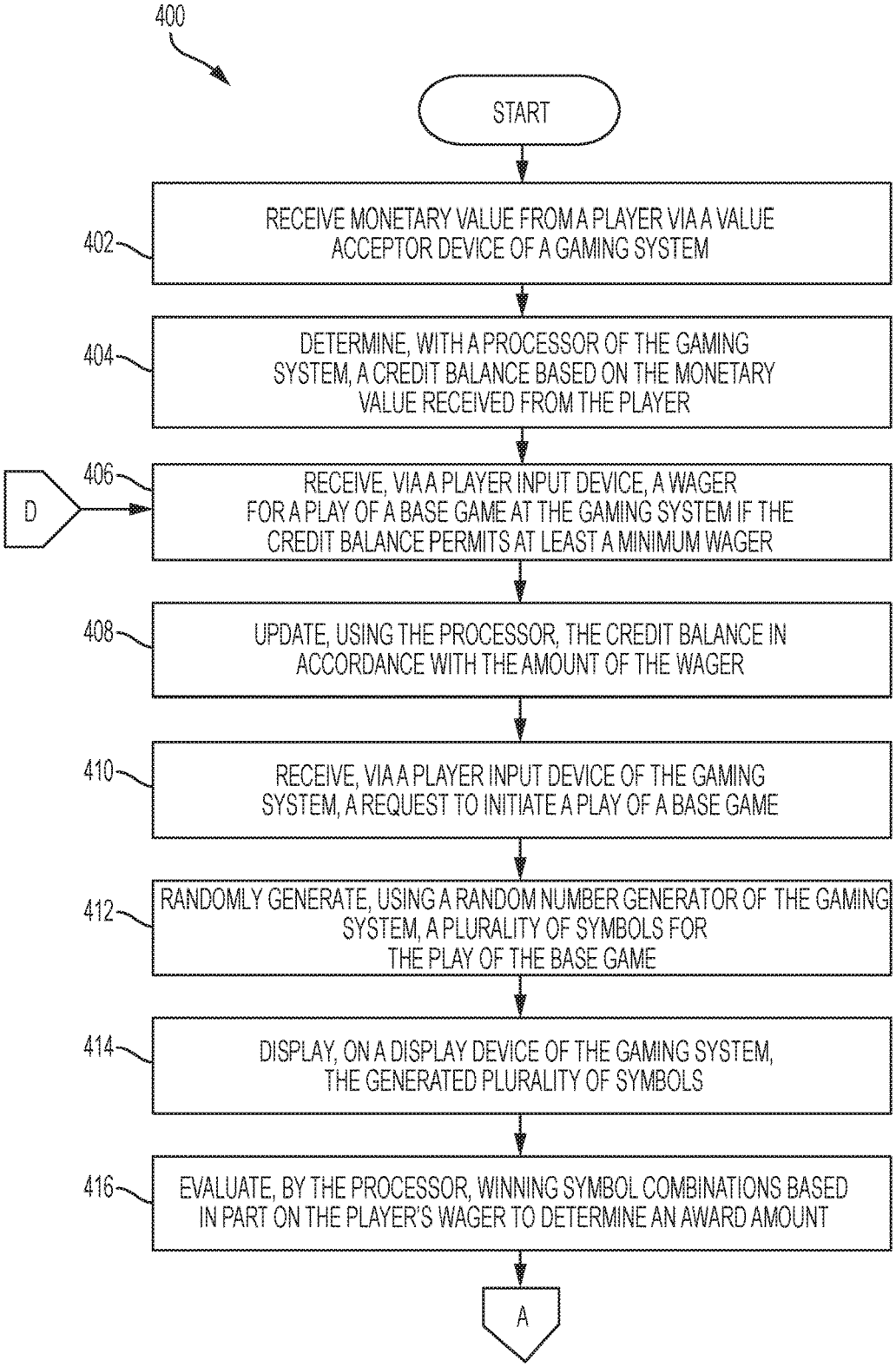
FIGS. 4A, 4B, and 4C illustrate a flow chart of a game having a base game and a bonus game having a practice round.
Figure 4B:
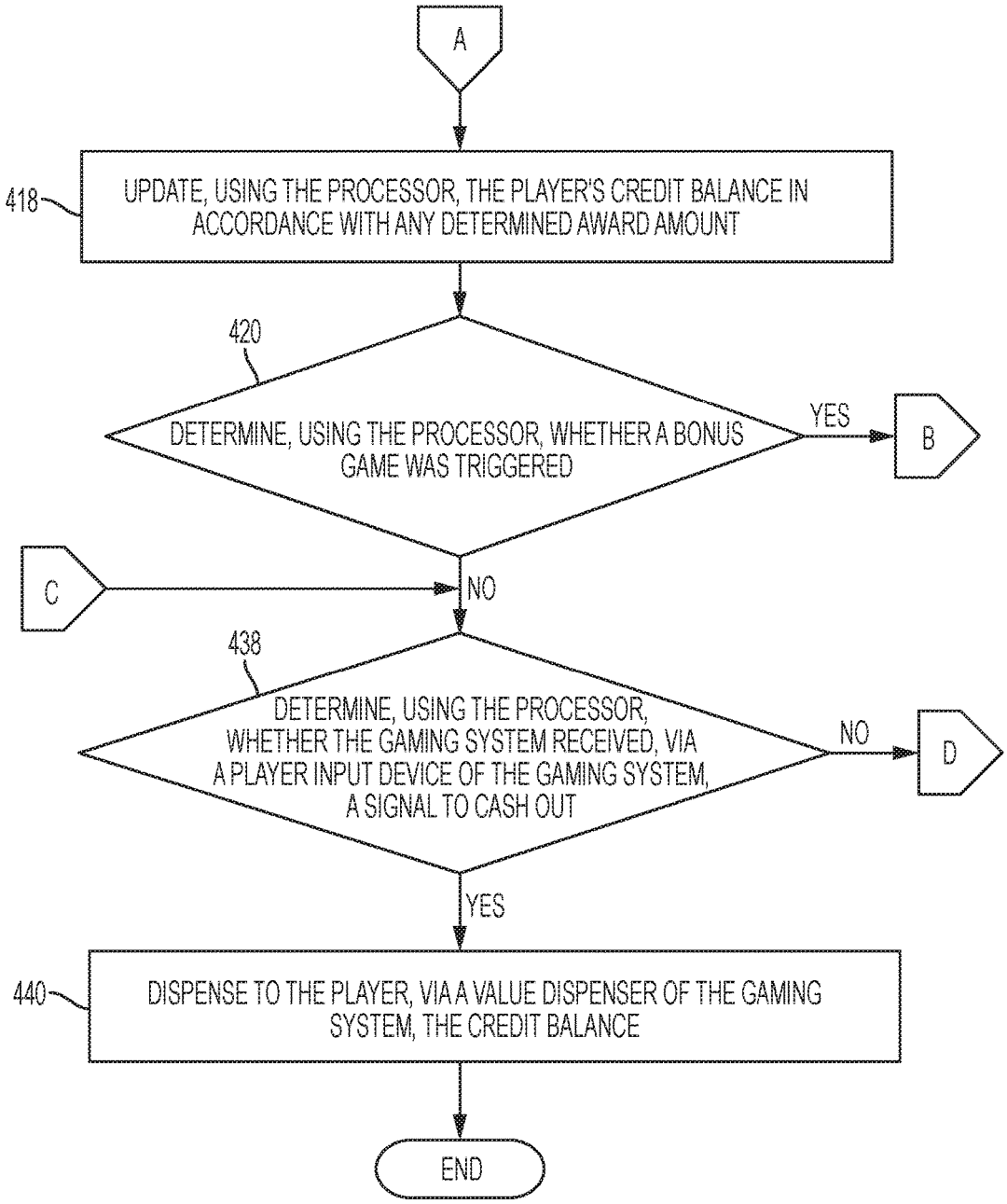
Figure 4C:
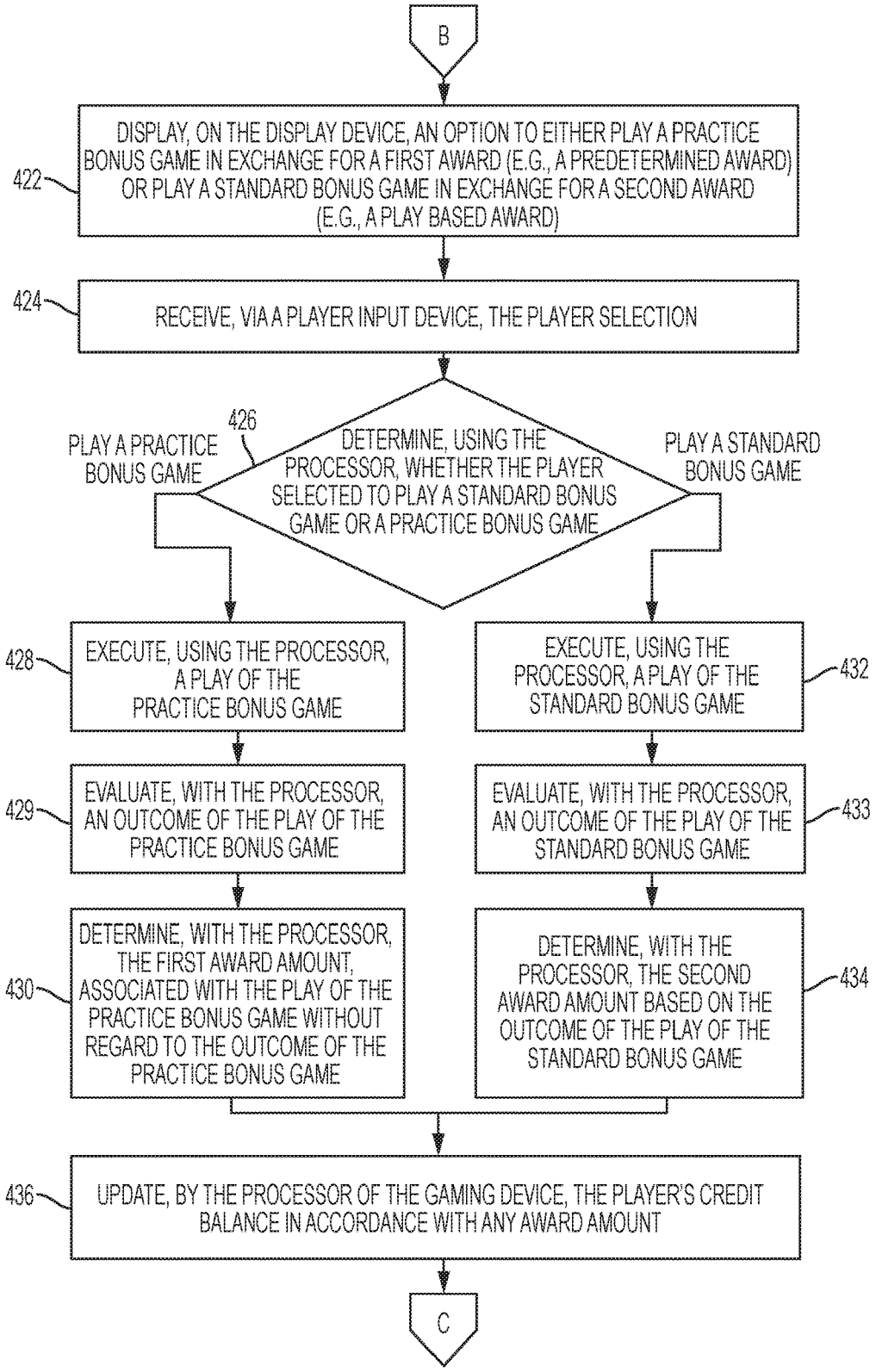

FIGS. 4A, 4B, and 4C illustrate a flowchart of an example operation 400 of one embodiment of the gaming system and method. In one embodiment, a processor may be configured, via instructions stored in a memory device, to perform the operation 400. However, it should be appreciated that other suitable variations of operation 400 are possible. For example, in one embodiment, fewer or one or more additional blocks (not shown) may be employed in operation 400 of the gaming system and method. In other embodiments, the blocks may be performed in any suitable order.

In the embodiment illustrated in FIGS. 4A, 4B, and 4C, a game (or base game) and a bonus game are provided in a gaming system. In one embodiment, the base game and the bonus game are games of chance. In another embodiment, the base game is a game of chance and the bonus game is a game of skill. In yet another embodiment, the based game can be either a game of chance or a game of skill while the bonus game is either a game of chance or a game of skill. In some embodiments, the games of chance outcomes are randomly determined. In some embodiments, the games of skill may be fully or partially based on the player's skill. In embodiments, where the game of skill is partially based on the player's skill, the game may also be partially based on chance. In some embodiments, the base game may award a play of the bonus game to the player, either randomly or based on the player's skill in the base game. The bonus game may allow the player to increase the base game's award amount. In one embodiment, the bonus game may require an element of skill. In the embodiment discussed below in connection with FIGS. 4A-4C, the base game is a slot game with spinning reels and the bonus game provides an option to play either a practice bonus game or a standard bonus game.

FIG. 4A illustrates one embodiment in which the gaming system receives a monetary value from a player to initiate operation 400. As indicated in block 402, the gaming system may receive monetary value via a value acceptor device associated with the gaming system. The value acceptor device may be, in one embodiment, disposed in a gaming device or in communication with the gaming device as discussed above.

In one embodiment, the gaming system may determine a credit balance based on the monetary value received from the player at the value acceptor device as indicated in block 404. The gaming system may increase, via the processor, the credit balance for the player as a result of the received monetary value.

In one embodiment, the gaming system receives a wager for a play of a game at the gaming system. Block 406 of FIG. 4A illustrates one embodiment where the player's wager may be received via a player input device of the gaming system. The gaming system enables the player to place a wager for a play of a game at the gaming system. In one embodiment, the gaming system may determine whether the player's credit balance includes enough credits to enable the player's selected wager. The gaming system may prevent the player from placing the wager and starting a play of a game if the player's credit balance is not large enough to support the player's selected wager. If enough credits are not available in the player's credit balance, the gaming system may enable the player to insert additional value to obtain the minimum credit level or to cash out of the gaming device.

In one embodiment, the gaming system updates the credit balance. The gaming system may use the processor to update the credit balance. The credit balance may be updated in accordance with the player's wager amount as indicated in block 408. Some embodiments, the credit balance is not updated until a later time.

As indicated in block 410, the gaming system may receive, via a player input device, a request to initiate a play of a base game. Upon receipt of this signal, the gaming system may randomly generate, using a random number generator, a plurality of symbols (from one or more sets of symbols) for the play of the base game as indicated in block 412. In block 414, the gaming system displays, on a display of the gaming system, the generated plurality of symbols on the reels. A processor of the gaming system evaluates the generated plurality of symbols for winning combinations of symbols, as illustrated in block 416. It should be appreciated that block 414 and block 416 can be reversed. In some embodiments, the determination of block 416 is made prior to the play of the base game. Returning to block 416, the gaming system's evaluation may be based, in part, on the player's wager and based in part on the generated symbols. If the gaming system determines winning symbol combinations were generated, the gaming system may also determine if the winning symbol combinations were generated along wagered pay lines. After the generated symbols are evaluated and the gaming system determined winning symbol combinations, the gaming system updates a player's credit balance with any determined award amounts. As illustrated in block 418 of FIG. 4B, the gaming system may use the processor to update the credit balance.

The gaming system, using the processor, may also determine whether a bonus game is triggered in step 420. The bonus game may be triggered by an event related to the base game. In one embodiment, the gaming system may trigger a bonus game based upon a certain symbol or combination of symbols being generated as part of the generated symbols of the base game (such as the generated symbols from block 412). In one embodiment, the bonus game may be triggered by an event unrelated to the base game. In one embodiment, the gaming system may randomly trigger the bonus game.

When the bonus game is triggered, as illustrated in FIG. 4C, block 422 illustrates one embodiment where the gaming system displays, on the display device, an option to play a bonus game in one of two different states. In one embodiment, the bonus game can be played as a practice bonus game (e.g., one game state) in exchange for a first award or the game can be played as a standard bonus game (e.g., a second game state) for a second award.

In one embodiment, the game play of the practice bonus game is similar to the game play of the standard bonus game. The practice bonus game enables the player to play the game in a practice environment with a low level of risk. In one embodiment, the practice bonus game provides an award to the player regardless or independent of the outcome of the bonus game. In one embodiment, the practice bonus game may provide a player with certain features that are not available in the standard bonus game. In one embodiment, the practice bonus game may provide help or other assistance in achieving a practice bonus game goal. For example, the practice bonus game may provide videos or audio explanations detailing how to play the bonus game. The practice bonus game may provide tips for successful play of the bonus game. The practice bonus game may provide the forgoing help at one or more different periods during a play of the practice bonus game. It should also be appreciated that in some embodiments, after playing the practice bonus game, the gaming system may also enable the player to play the standard bonus game (thus, enabling the player to play a practice bonus game and the standard bonus game upon the bonus game being triggered).

In one example embodiment, where the practice bonus game is a slot based game with spinning reels, the gaming system may provide audio and video tips for each step of a play of the game. For example, after receiving wager, the gaming system may provide audio or video instructions to a player to select pay lines. The gaming system may explain how many pay lines the player can select and how to select the pay lines. The gaming system may provide the same, similar, or other help and assistance as discussed above regarding FIG. 3B. Once the gaming system generated and displayed the symbols on the reels, the gaming system may highlight or indicate each pay line to the player and show how the gaming system evaluates the generated symbol combinations along active pay lines for the predetermined symbol combinations. If the gaming system determines a winning symbol combination along an active pay line, the gaming system may explain to the player the value of the winning symbol combination and show how the value of the winning symbol combination increases the player's credit balance. It should be appreciated that in some embodiments, the practice bonus game does not provide awards based on the practice bonus game outcome, thus in some embodiments, showing the player how the winning symbol combination increases the player's credit balance is merely to show the player what the player would have won if the player played the same game as the standard bonus game.

In some embodiments, the bonus game is a game of skill and the practice bonus game enables a player to develop the skills required for success in the standard bonus game with a low level of risk. Like the slot based game example above, the gaming system may provide various forms of help and assistance to the player during a play of the skills game played as a practice bonus game. In one embodiment, the skill required for success in the standard bonus game may relate to a player's timing of input signals and the practice bonus game may allow a player to practice timing skill. In one embodiment where the game is a driving game, the practice bonus game environment enables the player to practice driving one or more vehicles in the bonus driving game. In one embodiment, the practice bonus game may enable the player to practice a card game, such as video poker or blackjack. In one embodiment, the practice bonus game may enable the player to practice a target hitting bonus game. It should be appreciated that any type of game utilizing player input may be implemented in the gaming system as a practice bonus game and standard bonus game pairing.

In one embodiment, the practice bonus game is not a practice version of the standard bonus game. In some embodiments, the practice bonus game includes similar game features as the standard bonus game and may also include game features that are different. For example, in one slot game embodiment, the practice bonus game may include certain game symbols that are not available in the standard bonus game. In another slot game embodiment, the practice bonus game may include less game symbols than are available in the standard bonus game to reduce the complexity of the slot bonus game for the player. In some embodiments, the practice bonus game and the standard bonus game may be unrelated. In one embodiment, the practice bonus game may allow for the practice of at least one skill that is necessary for success in the standard bonus game while the game play in the practice bonus game is different from the standard bonus game.

In one embodiment, block 422 may include a display of information about the practice bonus game and information about the standard bonus game similar to the information discussed above in FIG. 3B.

In one embodiment, as illustrated in block 424, the gaming system receives the player's selection via the input device. The player may select either to play the standard bonus game or to play the practice bonus game. As illustrated in block 426, the gaming system determines, with the processor, if the player selected to play the practice bonus game or to play the standard bonus game.

At block 428, the gaming system executes, via the processor, the practice bonus game if the gaming system determines that the player selected the option to play the practice bonus game. In one embodiment, the practice bonus game is executed by the processor of the gaming system. Player inputs are received and executed by the gaming system to provide the practice bonus game.

In one embodiment, a play of the practice bonus game may, for example, operate more slowly than a play of the standard bonus game. As noted above, the practice bonus game may provide help and assistance to play the practice bonus game. The practice bonus game may provide information related to a skill required by a standard bonus game. In one embodiment, the practice bonus game may provide information regarding how to successfully achieve goals in standard bonus game play. In one embodiment, the information may be related to successful timing of player inputs and a player may be allowed to practice input timing.

The gaming system, using the processor, may evaluate an outcome of the play of the practice bonus game as illustrated in block 429. In one embodiment, the evaluation may include a display indicating any practice bonus game outcomes. In one embodiment of a chance game, the evaluation may include the gaming system displaying an indication of each winning symbol combination the player obtained in the practice bonus game. In another embodiment of a chance game, the evaluation may include the gaming system displaying an indication of each generated winning symbol combination and how the player could have obtained a greater number of winning symbol combinations if the player made different choices during the practice bonus game.

In one embodiment of a skills based game, the evaluation of block 429 may include the gaming system displaying an indication of one or more player skills that need improvement and could be improved with additional plays of the practice bonus game. In another embodiment of a skills game, the evaluation of block 429 may include the gaming system displaying an indication that the player's skills are excellent and additional plays of the practice bonus game are unnecessary. In one embodiment, the evaluation of block 429 may include a display indicating the award amount the player would have received if the player's game performance occurred in the standard bonus game. In this manner, when the player sees a display of an award amount greater than the award amount received in the practice bonus game, the player is encouraged to play the standard bonus game.

In block 430, the gaming system determines, with the processor, a first award amount associated with the play of the practice bonus game. The gaming system may make the determination of the first award amount that is independent of the outcome of the practice bonus game or otherwise without regard to the outcome of the practice bonus game. In some embodiments, the first award amount is guaranteed. In some embodiments, the first award amount is predetermined or fixed. In some embodiments, the first award amount is smaller than a value that could be obtained as the second award amount in the standard bonus game. In one embodiment, the first award amount is a nominal value. The nominal value may be, in one embodiment, a value equal to or less than the wager amount. In some embodiments, the nominal award may be a value that is less than, equal to, or greater than the wager amount. In some embodiments, the nominal value may be a fixed percentage of the player's wager. Thus, in some embodiments, the player is confident that the first award will be achieved while playing the practice bonus game (reducing the player's potential losses), which encourages the player to play the practice bonus game. Thus, it should be appreciated that in some embodiments of the practice bonus game, certain types of awards may encourage the player to play the practice bonus game where the player is not penalized for selecting to play the practice bonus game. In some embodiments, the award from a play of the practice bonus game may be variable, but associated with a lower volatility, which enables the player to gain confidence through plays of the practice bonus game and still achieve excitement and anticipation of winning different awards.

Turning to block 432 of FIG. 4C, if the player selects to play the standard bonus game option, the gaming system executes, via the processor, the standard bonus game. In one embodiment, the gaming system receives the player's inputs and executes the bonus game in conjunction with the player inputs to provide the standard bonus game. As noted above, the standard bonus game in some embodiments is the same or a similar game as the practice bonus game, without the help and assistance provided in the practice bonus game.

In one embodiment, the game play of the standard bonus game is similar to the practice bonus game, but does not have certain features such as providing tips, help, or other assistance to the player during the game. In other embodiments, the standard bonus game includes tips, help, or other assistance. In one embodiment, the standard bonus game is played at a standard speed or pace, which is faster than the speed or pace of the practice bonus game. In some embodiments, the pace of the standard bonus game is the same as the practice bonus game. In some embodiments, the standard bonus game enables the player to win awards larger than awards in the practice bonus game. In some embodiments, the standard bonus game award is variable and is associated with a volatility that is larger or even substantially larger than the volatility of the practice bonus game. The gaming system may evaluate, with the processor, an outcome of the play of the standard bonus game in some embodiments. The gaming system may evaluate, with the processor, an outcome of the play of the standard bonus game based on how well the player played the standard bonus game in some embodiments. In some embodiments, the award in the standard bonus game is based upon the outcome of the play of the standard bonus game, based on how well the player played the standard bonus game, or a combination of both. In one embodiment, the game play of the standard bonus game may not be similar to the practice bonus game, but the standard bonus game may require a skill that is practiced in the practice bonus game.

In one embodiment, the gaming system may evaluate, with the processor, an outcome of the play of the standard bonus game as indicted in block 433. In one embodiment of a game of chance, the gaming system may evaluate generated symbols for a play of a game and determine if winning symbol combinations were generated. In one embodiment directed to a game of skill, the standard bonus game may require the player to manipulate game characters during a play of the game to achieve certain goals. The gaming system may capture and evaluate the player's actions for any achieved goals. In one embodiment, the standard bonus game may require a decision-making skill, and the gaming system may evaluate decisions. It should be appreciated that any suitable variety of standard bonus games and game evaluations are possible.

As illustrated in block 434, the gaming system may determine, with the processor, the second award amount based on the outcome of the play of the standard bonus game. In one embodiment, the second award amount is associated with a volatility that is larger or substantially larger than the volatility of the practice bonus game. In one embodiment, a maximum value of the second award amount may be set higher than the first award amount. In one embodiment, the value of the second award amount is variable. In one embodiment, the second award amount may include a base value and a value that the gaming system determines based on the player's performance in the play of the standard bonus game. In another embodiment, the second award amount may be based solely on the player's performance in the play of the standard bonus game. Thus, in some embodiments, the player is rewarded for skillful play of the standard bonus game.

The gaming system may update, using the processor, a player's credit balance in accordance with any determined award amounts from either a play of the practice bonus game or a play of the standard bonus game, as illustrated in block 436. The process 400 thereafter returns to FIG. 4B via off page connector C to block 438 in one embodiment.

At block 438 in FIG. 4B, the gaming system determines, using the processor, whether the gaming system has received a cash out signal from a player input device. When the cash out signal is received, the gaming system can dispense a value to the player via a value dispenser of the gaming device in accordance with the player credit balance as indicated in block 440. If the gaming system determines that no cash out signal was received, then gaming system may return to block 406. Block 406 illustrates the gaming system enabling the player to continue the gaming session by placing at least one additional wager to play another play of the game (including plays of the base game and chances to play either the practice bonus game or standard bonus game).

In some embodiments, the gaming system may offer a player a plurality of different practice bonus games. Thus, in some embodiments, the gaming system may offer two or more game states. In one such embodiment, the bonus game can be played as a first practice bonus game (e.g., a first game state) in exchange for a first award, the bonus game can be played as a second practice bonus game (e.g., a second game state) in exchange for a second award, or the game can be played as a standard bonus game (e.g., a third game state) for a third award. It should be appreciated that any number of practice games or game states can be implemented. The first award and the second award can be the same or different in some embodiments. The third award is different from the first and second awards in some embodiments. In one example embodiment, the standard bonus game can be a space shooting game, where a player's spaceship can be maneuvered around space debris, the player's spaceship shoots enemy spaceships, and the player's spaceship avoids shots fired from enemy spaceships. In one embodiment, the first practice bonus game may be limited to the player learning to fly the player's spaceship around the space debris without including any enemy spaceships to shoot or shots to avoid from enemy spaceships in the first practice bonus game. In one embodiment, the second practice bonus game can include all or most of the features of the standard bonus game. Thus, the gaming system may offer a player more than one practice bonus game in addition to the standard bonus game. It should also be appreciated that the gaming system can also be configured with one or more standard bonus games.

Figure 5A:
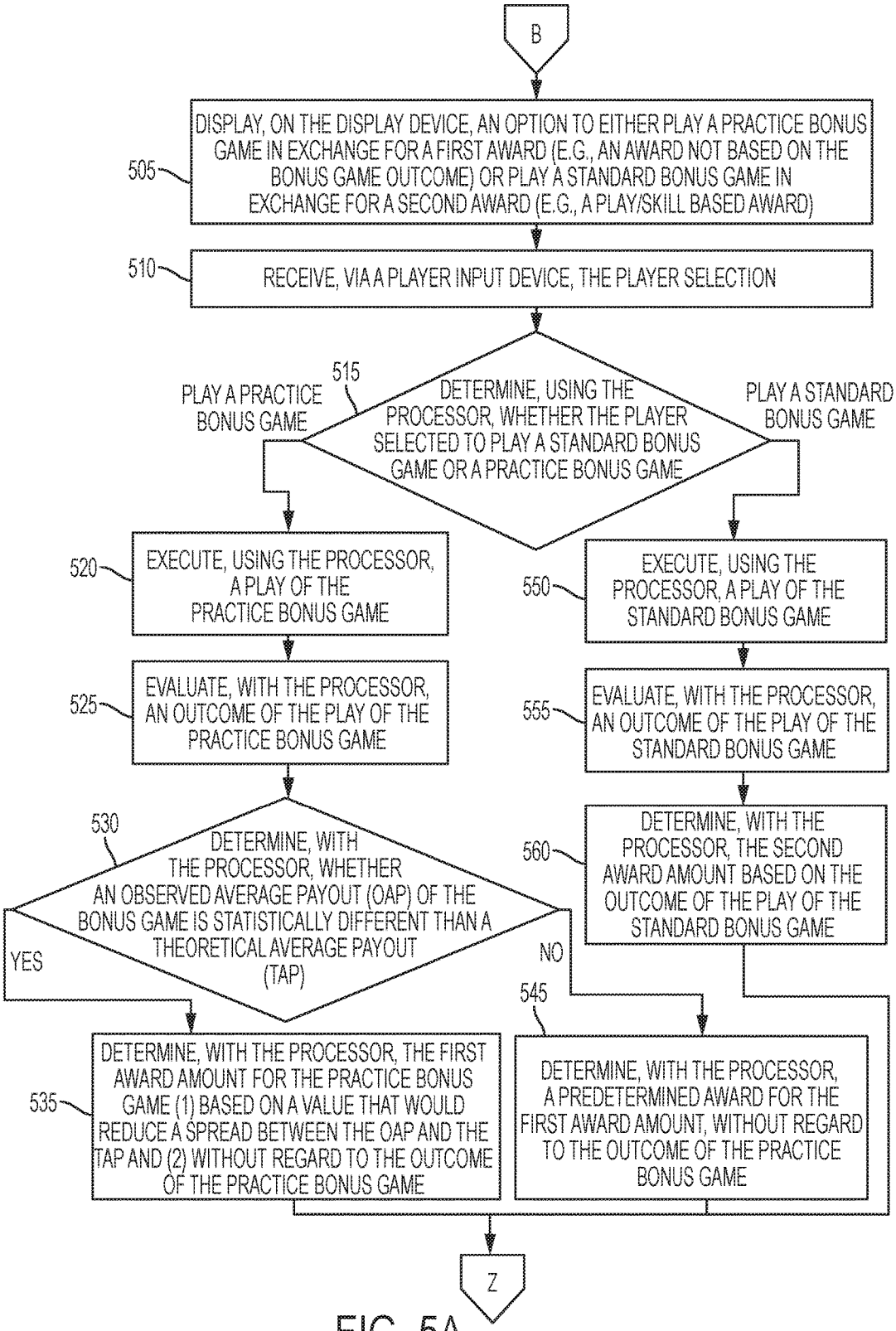
FIGS. 5A and 5B illustrate a flow chart of an alternative bonus game from FIGS. 4A-4C, where the gaming system may dynamically adjust a practice bonus game award based on a difference between an observed average payout and a theoretical average payout of the overall game from FIGS. 4A-4C.
Figure 5B:
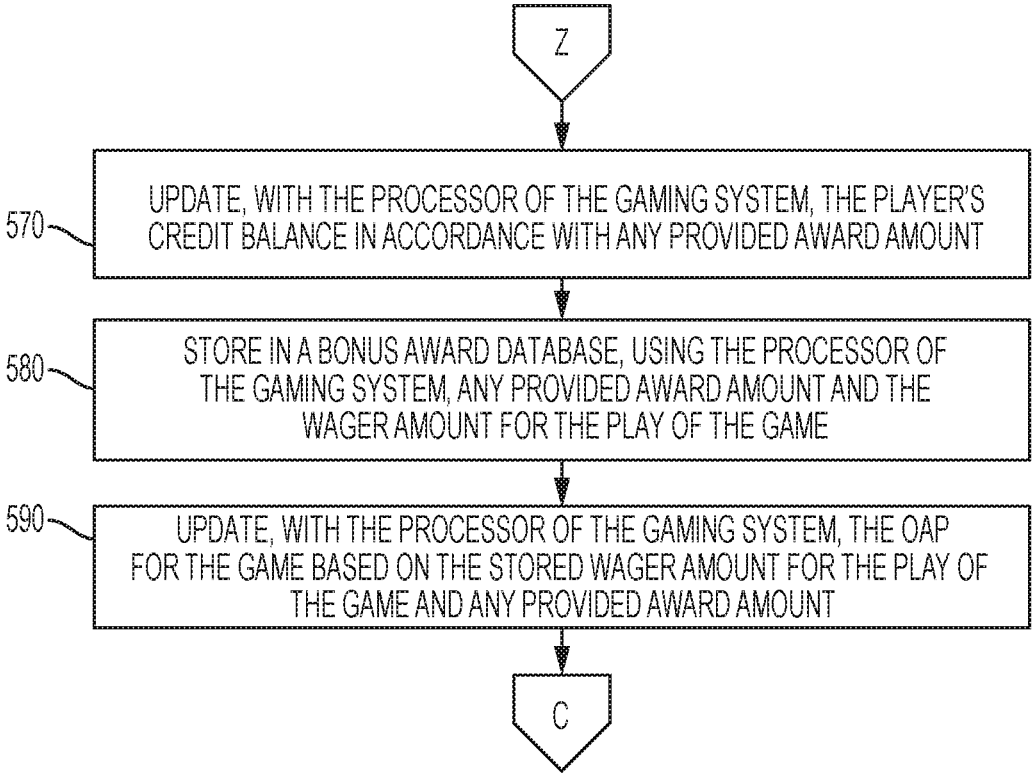

FIG. 5A and FIG. 5B illustrate alternative embodiment of the features illustrated in connection with FIG. 4C. In particular, the gaming system in some embodiments is configured to dynamically adjust payout amounts offered in association with the practice bonus game to correct for a game that on average, pays out more or less than the gaming system was designed to payout.

A game on a gaming system that awards a player with value for certain game outcomes is generally configured in such a way to have a calculable theoretical Return To Player (theoretical RTP) value. The theoretical RTP is a statistically expected return of total money (from all players) bet over an extended number (e.g., millions) of plays of the game on the gaming system and expressed as a percentage of money wagered. The theoretical RTP percentage can also be viewed as defining the hold of the gaming system (i.e., the amount of money retained by the gaming system for the casino or "house). For example, a theoretical RTP value of 92.8% means that over many plays of a game on a gaming system utilizing a particular symbol set (or a plurality of symbol sets), an average of $92.80 will be paid out for every $100 wagered on the gaming system. The remaining $7.20 wagered on the gaming system will be retained by the house. In a like manner, a theoretical RTP value of 86% means that over many plays of a game on a gaming system utilizing a particular symbol set (or a plurality of symbol sets), an average of $86 will be paid out for every $100 wager on the gaming system. The remaining $14 wagered on the gaming system will be retained by the house.

Generally, the theoretical RTP for a three reel gaming system using a 20 symbol set for each reel may be calculated by identifying the defined winning outcome combinations expressed in a pay table of a game for the gaming system and calculating a probability of the occurrence of each one of the defined winning combinations. The probabilities of occurrence of each one of the defined winning outcome combinations are then summed to obtain the theoretical RTP of the symbol set (or symbol sets).

In some embodiments, a gaming system may be configured to include an RTP calculation system to calculate an actual or observed RTP of a game over an extended number of plays of a game on a gaming system. In some embodiments, the RTP calculation system may track wagers to play a game and payouts provided to players over many plays of a game over to determine the observed RTP for the game. The observed RTP and the theoretical RTP should be statistically close. However, there are times when a game on a gaming system may not generate an observed RTP that statistically matches the game's theoretical RTP over many plays of the game. That is, in some cases, the gaming system may provide a higher or lower observed RTP than the planned theoretical RTP for the game. The variations between a theoretical RTP and an observed RTP in a game may relate to variable aspects of the game that are hard to accurately calculate with statistics. In some embodiments, the variations between a theoretical RTP and an observed RTP in a game may relate merely to random outcomes of the game that defy theoretical statistics. In such embodiments, the gaming system can be configured to dynamically adjust, before, during, or after a play of a game what the gaming system pays out to a player for certain aspects of a game (e.g., a practice bonus game), to normalize any differences between the theoretical RTP and the observed RTP for the game (including any base and bonus game).

Returning back to FIG. 5A, when the bonus game is triggered, block 505 illustrates one embodiment where the gaming system displays, on the display device, an option to play a bonus game in one of two different states. In one embodiment, the bonus game can be played as a practice bonus game in exchange for a first award or the game can be played as a standard bonus game for a second award.

In one embodiment, the game play of the practice bonus game is similar to the game play of the standard bonus game. The practice bonus game enables the player to play the game in a practice environment with a low level of risk. In one embodiment, the practice bonus game provides the first award to the player regardless or independent of the outcome of the practice bonus game. In one embodiment, the practice bonus game may provide a player with certain features that are not available in the standard bonus game. In one embodiment, the practice bonus game may provide help or other assistance in achieving a practice bonus game goal. For example, the practice bonus game may provide videos or audio explanations detailing how to play the bonus game. The practice bonus game may provide tips for successful play of the bonus game. The practice bonus game may provide the forgoing help at one or more different periods during a play of the practice bonus game. It should also be appreciated that in some embodiments, after playing the practice bonus game, the gaming system may also enable the player to play the standard bonus game (thus, enabling the player to play a practice bonus game and the standard bonus game upon the bonus game being triggered).

In one example embodiment, where the practice bonus game is a slot based game with spinning reels, the gaming system may provide audio and video tips for each step of a play of the game. For example, after receiving wager, the gaming system may provide audio or video instructions to a player to select pay lines. The gaming system may explain how many pay lines the player can select and how to select the pay lines. The gaming system may provide the same, similar, or other help and assistance as discussed above regarding FIG. 3B. Once the gaming system generated and displayed the symbols on the reels, the gaming system may highlight or indicate each pay line to the player and show how the gaming system evaluates the generated symbol combinations along active pay lines for the predetermined symbol combinations. If the gaming system determines a winning symbol combination along an active pay line, the gaming system may explain to the player the value of the winning symbol combination and show how the value of the winning symbol combination increases the player's credit balance. It should be appreciated that in some embodiments, the practice bonus game does not provide awards based on the practice bonus game outcome, thus in some embodiments, showing the player how the winning symbol combination increases the player's credit balance is merely to show the player what the player would have won if the player played the same game as the standard bonus game.

In some embodiments, the bonus game is a game of skill and the practice bonus game enables a player to develop the skills required for success in the standard bonus game with a low level of risk. Like the slot based game example above, the gaming system may provide various forms of help and assistance to the player during a play of the skills game played as a practice bonus game. In one embodiment, the skill required for success in the standard bonus game may relate to a player's timing of input signals and the practice bonus game may allow a player to practice timing skill. In one embodiment where the game is a driving game, the practice bonus game environment enables the player to practice driving one or more vehicles in the bonus driving game. In one embodiment, the practice bonus game may enable the player to practice a card game, such as video poker or blackjack. In one embodiment, the practice bonus game may enable the player to practice a target hitting bonus game. It should be appreciated that any type of game utilizing player input may be implemented in the gaming system as a practice bonus game and standard bonus game pairing.

In one embodiment, the practice bonus game is not a practice version of the standard bonus game. In some embodiments, the practice bonus game includes similar game features as the standard bonus game and may also include game features that are different. For example, in one slot game embodiment, the practice bonus game may include certain game symbols that are not available in the standard bonus game. In another slot game embodiment, the practice bonus game may include less game symbols than are available in the standard bonus game to reduce the complexity of the slot bonus game for the player. In some embodiments, the practice bonus game and the standard bonus game may be unrelated. In one embodiment, the practice bonus game may allow for the practice of at least one skill that is necessary for success in the standard bonus game while the game play in the practice bonus game is different from the standard bonus game.

In one embodiment, block 505 may include a display of information about the practice bonus game and information about the standard bonus game similar to the information discussed above in FIG. 3B.

In one embodiment, as illustrated in block 510, the gaming system receives the player's selection via the input device. The player may select either to play the standard bonus game or to play the practice bonus game. As illustrated in block 515, the gaming system determines, with the processor, if the player selected to play the practice bonus game or to play the standard bonus game.

At block 520, the gaming system executes, via the processor, the practice bonus game if the gaming system determines that the player selected the option to play the practice bonus game. In one embodiment, the practice bonus game is executed by the processor of the gaming system. Player inputs are received and executed by the gaming system to provide the practice bonus game.

In one embodiment, a play of the practice bonus game may, for example, operate more slowly than a play of the standard bonus game. As noted above, the practice bonus game may provide help and assistance to play the practice bonus game. The practice bonus game may provide information related to a skill required by a standard bonus game. In one embodiment, the practice bonus game may provide information regarding how to successfully achieve goals in standard bonus game play. In one embodiment, the information may be related to successful timing of player inputs and a player may be allowed to practice input timing.

The gaming system, using the processor, may evaluate an outcome of the play of the practice bonus game as illustrated in block 525. In one embodiment, the evaluation may include a display indicating any practice bonus game outcomes. In one embodiment of a chance game, the evaluation may include the gaming system displaying an indication of each winning symbol combination the player obtained in the practice bonus game. In another embodiment of a chance game, the evaluation may include the gaming system displaying an indication of each generated winning symbol combination and how the player could have obtained a greater number of winning symbol combinations if the player made different choices during the practice bonus game.

In one embodiment of a skills based game, the evaluation of block 525 may include the gaming system displaying an indication of one or more player skills that need improvement and could be improved with additional plays of the practice bonus game. In another embodiment of a skills game, the evaluation of block 525 may include the gaming system displaying an indication that the player's skills are excellent and additional plays of the practice bonus game are unnecessary. In one embodiment, the evaluation of block 525 may include a display indicating the award amount the player would have received if the player's game performance occurred in the standard skill based bonus game (where the size of the award amount may be associated with how well the player performs in the skill based bonus game). In this manner, when the player sees a display of an award amount greater than the award amount received in the practice bonus game, the player is encouraged to play the standard bonus game.

In block 530, the gaming system determines, with the processor, whether an actual or observed average payout (OAP) of the bonus game is statistically different from a predetermined theoretical average payout (TAP). It should be appreciated that in some embodiments, the gaming system may have determined whether the OAP of the bonus game is statistically different from a TAP before or during the play of the game (bonus or base game).

If the processor of the gaming system determines that the OAP and the TAP are statistically different at block 530, the gaming system moves to block 535 to determine the first award amount for the practice bonus game. In block 535, the gaming system determines the first award based on a value that would reduce a spread between the OAP and the TAP. For example, if the OAP is higher than the TAP, the gaming system may select an award amount for the first award that would reduce the OAP and bring the OAP statistically closer to the TAP to reduce the spread. As another example, if the OAP is lower than the TAP, the gaming system may select an award amount for the first award that would increase the OAP and bring the OAP statistically closer to the TAP to reduce the spread. It should be appreciated that such award amounts are dynamically generated and may change between plays of the game. In some embodiments, the gaming system may determine award amounts for the first award that drastically alter the OAP to reduce the spread between the OAP and the TAP. In other embodiments, the gaming system may determine small changes to the OAP over many games to slowly alter the OAP to reduce the spread between the OAP and the TAP. In some embodiments, the gaming system also determines the first award without regard to the outcome of the practice bonus game, as was discussed in connection with block 430 in FIG. 4C. The gaming system may thereafter move to FIG. 5B via off page connector Z and block 570.

Returning to block 530, if the processor of the gaming system determines that the OAP and the TAP are not statistically different at block 530, the gaming system moves to block 545 to issue the first award amount for the practice bonus game. In block 545, the gaming system determines a predetermined award for the first award amount. The gaming system may make the determination of the first award amount that is independent of the outcome of the practice bonus game or otherwise without regard to the outcome of the practice bonus game. In some embodiments, the first award amount is guaranteed. In some embodiments, the first award amount is predetermined or fixed. In some embodiments, the first award amount is smaller than a value that could be obtained as the second award amount in the standard bonus game. In one embodiment, the first award amount is a nominal value. The nominal value may be, in one embodiment, a value equal to or less than the wager amount. In some embodiments, the nominal value may be a value that is less than, equal to, or greater than the wager amount. In some embodiments, the nominal value may be a fixed percentage of the player's wager. Thus, in some embodiments, the player is confident that the first award will be achieved while playing the practice bonus game (reducing the player's potential losses), which encourages the player to play the practice bonus game. Thus, it should be appreciated that in some embodiments of the practice bonus game, certain types of awards may encourage the player to play the practice bonus game where the player is not penalized for selecting to play the practice bonus game. In some embodiments, the award from a play of the practice bonus game may be variable, but associated with a lower volatility, which enables the player to gain confidence through plays of the practice bonus game and still achieve excitement and anticipation of winning different awards. The gaming system may thereafter move to FIG. 5B via off page connector Z and block 570 in one embodiment.

For the sake of brevity, block 550, block 555, and block 560 substantially correspond to block 432, block 433, and block 434, respectively (of FIG. 4C) and will not be discussed again. Upon the completion of block 560, the gaming system may thereafter move to FIG. 5B via off page connector Z and block 570 in one embodiment.

As illustrated in block 570 of FIG. 5B, the gaming system may update, using the processor, a player's credit balance in accordance with any determined award amounts from either a play of the practice bonus game or a play of the standard bonus game. In some embodiments, the gaming system may also store in a database any provided award amount (depending on whether the player obtained an award) and the player's wager amount for the play of the game as illustrated in block 580. As illustrated in block 590, the gaming system may update with the processor, the OAP for the game based on the stored wager amount for the play of the game and any provided award amount for the play of the game. It should be appreciated that in some embodiments, the wager amount is for the game (which may include a base and bonus game) and the provided award amount for the play of the game may include both awards for the base and bonus game (where applicable). In some embodiments, the OAP may be calculated for just a bonus game and may be compared to a TAP calculated for just the bonus game. In one embodiment, the alternative process 400 of FIG. 5A and FIG. 5B thereafter returns to block 438 of FIG. 4B via off page connector C and continues as discussed above in connection with FIG. 4B.

Figure 6A:
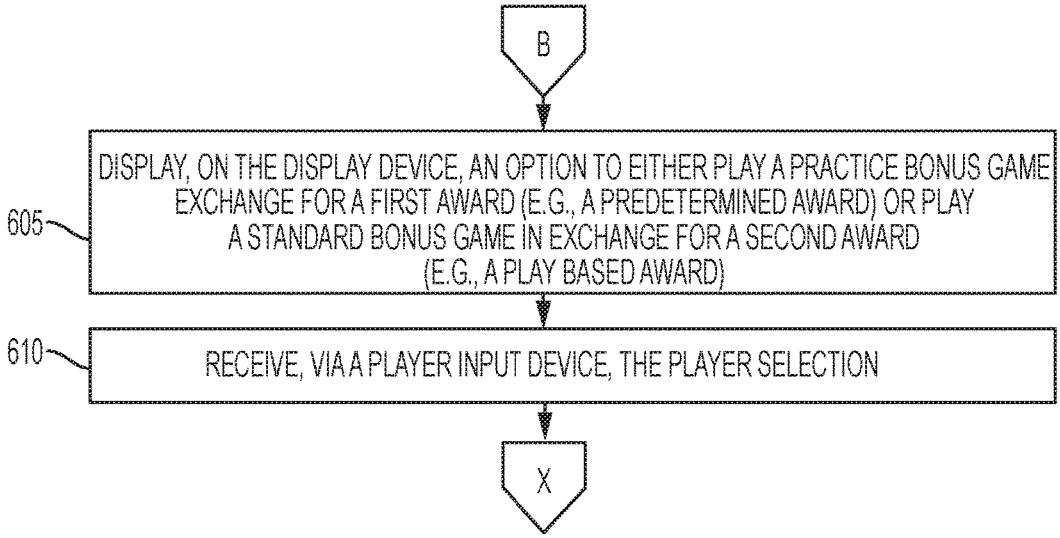
FIGS. 6A and 6B illustrate a flow chart of an alternative bonus game from FIGS. 4A-4C, where the gaming system permits a player to play a predetermined quantity of additional practice games.
Figure 6B:
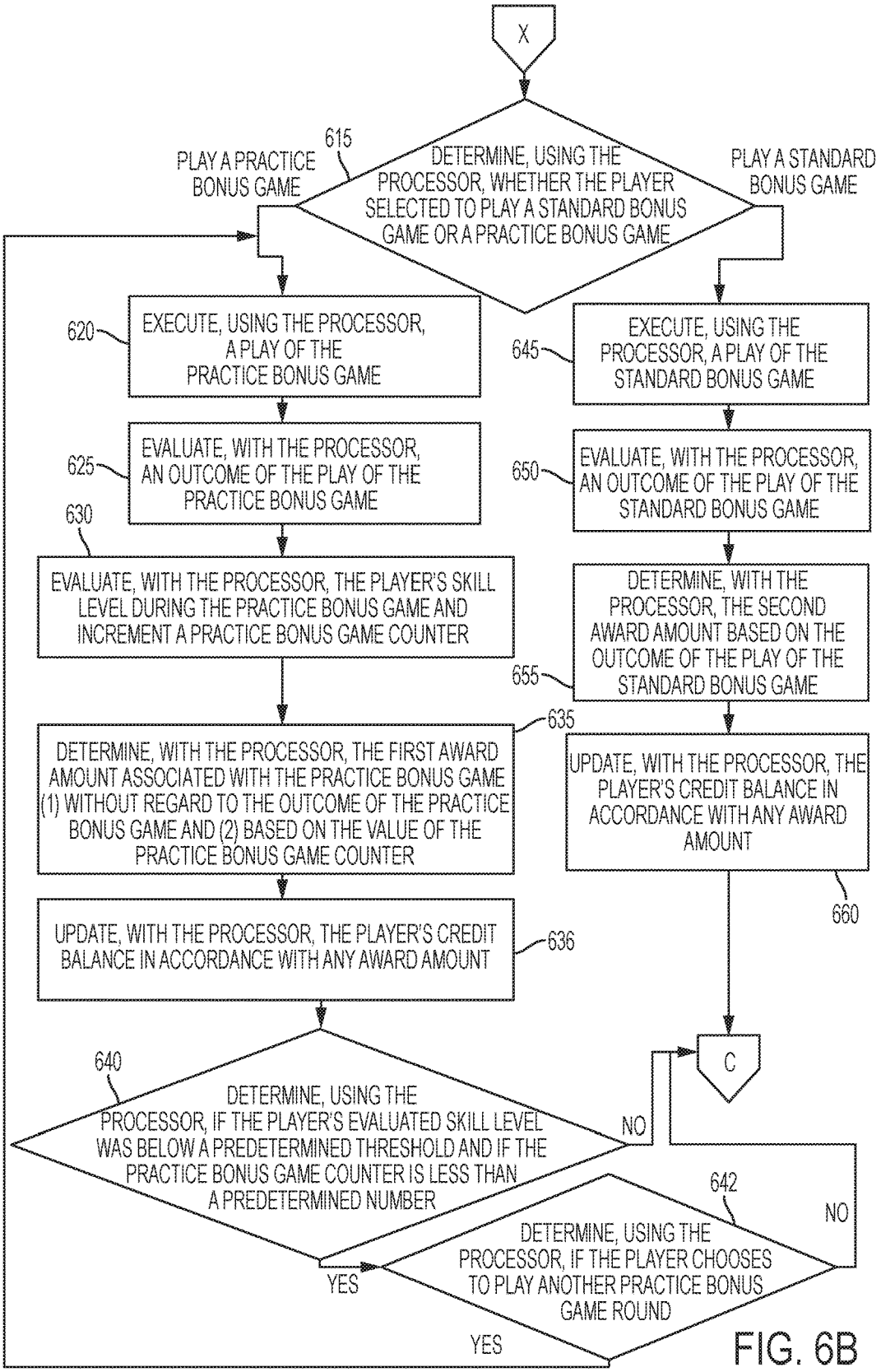

FIGS. 6A and 6B illustrate another alternative embodiment of the features illustrated in connection with FIG. 4C. In particular, the gaming system in some embodiments is configured to permit a player to play a predetermined quantity of additional practice bonus games under certain circumstances. In some embodiments, the gaming system determines an award for the practice bonus game based on the quantity of additional practice bonus games the player has played during a play of a game.

For the sake of brevity, block 605, block 610, and block 615 of FIG. 6A and FIG. 6B substantially correspond with block 422, block 424, and block 426, respectively (of FIG. 4C) and will not be discussed again. The operation discussed in FIG. 6A moves to FIG. 6B via off-page connector X. Similarly, block 645, block 650, block 655, and block 660 of FIG. 6B substantially correspond with block 432, block 433, block 434, and block 436, respectively (of FIG. 4C) and will not be discussed again.

Starting at block 620, the gaming system executes, via the processor, the practice bonus game if the gaming system determines that the player selected the option to play the practice bonus game. In one embodiment, the practice bonus game is executed by the processor of the gaming system. Player inputs are received and executed by the gaming system to provide the practice bonus game.

In one embodiment, a play of the practice bonus game may, for example, operate more slowly than a play of the standard bonus game. As noted above, the practice bonus game may provide help and assistance to play the practice bonus game. The practice bonus game may provide information related to a skill required by a standard bonus game. In one embodiment, the practice bonus game may provide information regarding how to successfully achieve goals in standard bonus game play. In one embodiment, the information may be related to successful timing of player inputs and a player may be allowed to practice input timing.

The gaming system, using the processor, may evaluate an outcome of the play of the practice bonus game as illustrated in block 625. In one embodiment, the evaluation may include a display indicating any practice bonus game outcomes. In one embodiment of a chance game, the evaluation may include the gaming system displaying an indication of each winning symbol combination the player obtained in the practice bonus game. In another embodiment of a chance game, the evaluation may include the gaming system displaying an indication of each generated winning symbol combination and how the player could have obtained a greater number of winning symbol combinations if the player made different choices during the practice bonus game.

In one embodiment of a skills based game, the evaluation of block 625 may include the gaming system displaying an indication of one or more player skills that need improvement and could be improved with additional plays of the practice bonus game. In another embodiment of a skills game, the evaluation of block 625 may include the gaming system displaying an indication that the player's skills are excellent and additional plays of the practice bonus game are unnecessary. In one embodiment, the evaluation of block 625 may include a display indicating the award amount the player would have received if the player's game performance occurred in the standard skill based bonus game (where the size of the award amount may be associated with how well the player performs in the skill based bonus game). In this manner, when the player sees a display of an award amount greater than the award amount received in the practice bonus game, the player is encouraged to play the standard bonus game.

In block 630, the gaming system evaluates the player's skill level during the practice bonus game. For example, the gaming system may evaluate the player's response times to certain activities during the play of the practice bonus game. In some embodiments, the gaming system may increment a practice bonus game counter before, during, or after the player plays the practice bonus game. It should be appreciated that in some embodiments, the evaluation is the same or similar to the evaluations discussed in connection with FIG. 3B and FIG. 4C.

In block 635, the gaming system determines with the processor, a first award amount associated with the practice bonus game. In some embodiments, the first award amount is without regard to the outcome of the practice bonus round. For example, the player may play skillfully or play poorly, however, the player's in game performance does not influence the first award amount. In other words, the first award amount is independent of the player's performance in the game in some embodiments. In some embodiments, the first award may be provided similar to the first award described in connection with FIG. 3B or 4C. In some embodiments, the gaming system also determines the first award amount based on the practice bonus game counter number. For example, if the practice bonus game counter indicates that a player is playing the practice bonus round for the first time during the play of the game (e.g., including any base game), the gaming system may determine the first award amount the same or similar to how the first award amount is determined in FIG. 4C. However, if the gaming system determines that the practice bonus game counter indicates that the player is playing the practice bonus round for an nth time during the play of the game, the gaming system may determine that the player is eligible for a different predetermined award. In some embodiments, if the nth time is greater than, or greater than or equal to a predetermined threshold, the gaming system may award a predetermined award that is lower than a previous award the gaming system provided to the player during a prior play of the bonus practice round within the play of the game. For example, in some embodiments, the predetermined threshold is two practice bonus games. If the gaming system determines that the player has already played one practice bonus game during a play of the game, the gaming system determines that a nominal award value should be provided to the player because the player already obtained an award for playing the practice bonus game under the player's original wager for the play of the game (e.g., any base and bonus game). In some embodiments, the gaming system determines that no award value should be provided to the player because the player already obtained an award for playing the practice bonus game under the player's original wager for the play of the game (e.g., any base and bonus game). In some embodiments of block 635, combining the features discussed in connection with FIG. 5A and FIG. 5B, the gaming system may base the determined award value on reducing the spread between the OAP and the TAP. In some such embodiments when the TAP is greater than the OAP, the award value used to normalize the spread between the OAP and the TAP is reduced for each subsequent play of the practice bonus game within a play of the game so that one player is not provided disproportionate award from other players during one or more plays of the practice bonus game.

Moving to block 636, the gaming system may update, using the processor, a player's credit balance in accordance with any determined award amounts in some embodiments (such as discussed in connection with block 436). At block 640, the gaming system determines, using the processor, if the player's evaluated skill level was below a predetermined threshold for the play of the practice bonus game and if the practice bonus game counter is less than a predetermined number. If the player's evaluated skill level is below the predetermined threshold and the practice bonus game counter is less than the predetermined number, the gaming system may offer the player another chance to play the practice bonus game within the play of the game. In some embodiments the predetermined number of the practice bonus game counter is two; however, any suitable number can be used for the predetermined number. The player's skill level may be determined using player information captured during the play of the practice bonus game. In some embodiments, the gaming system does not track the number of practice bonus games the player played during the play of the game and allows the player to continue to play additional rounds of the practice bonus game during a play of the game while the player's evaluated skill level is below the predetermined threshold. In some embodiments, the gaming system enables the player to continue to play additional rounds of the practice bonus game based on the player paying for additional plays of the practice bonus game. In such embodiments, the gaming system may provide no awards for playing the practice bonus game or provide diminishing nominal awards for each additional round of the practice bonus game played during a play of the game. In some embodiments, after playing an initial round of the practice bonus game during a play of the game, the gaming system provides the player a predetermined quantity of additional plays of the practice bonus game during the play of the game if the player's evaluated skill level is below the predetermined threshold.

In some embodiments, if the player's evaluated skill level is above the predetermined threshold or if the practice bonus game counter is greater than a predetermined number, the alternative process 400 illustrated in FIG. 6B thereafter returns to block 438 of FIG. 4B via off page connector C and continues as discussed above in connection with FIG. 4B. In some embodiments, the gaming system may continue to offer the player another chance to play the practice bonus game if the practice bonus game counter is less than a predetermined number (even if the player's evaluated skill level is greater than a predetermined threshold).

In some embodiments, if the gaming system offers the player another opportunity to play the practice bonus game, the gaming system determines if the player chooses to play another round of the practice bonus game as illustrated in block 642. If the player chooses to play another round of the practice bonus game, the alternative process 400 illustrated in FIG. 6B returns to block 620. On the other hand, if the gaming system determines that the player does not elect to play another practice bonus game round, the alternative process 400 illustrated in FIG. 6B thereafter returns to block 438 of FIG. 4B via off page connector C and continues as discussed above in connection with FIG. 4B.

Figure 7:
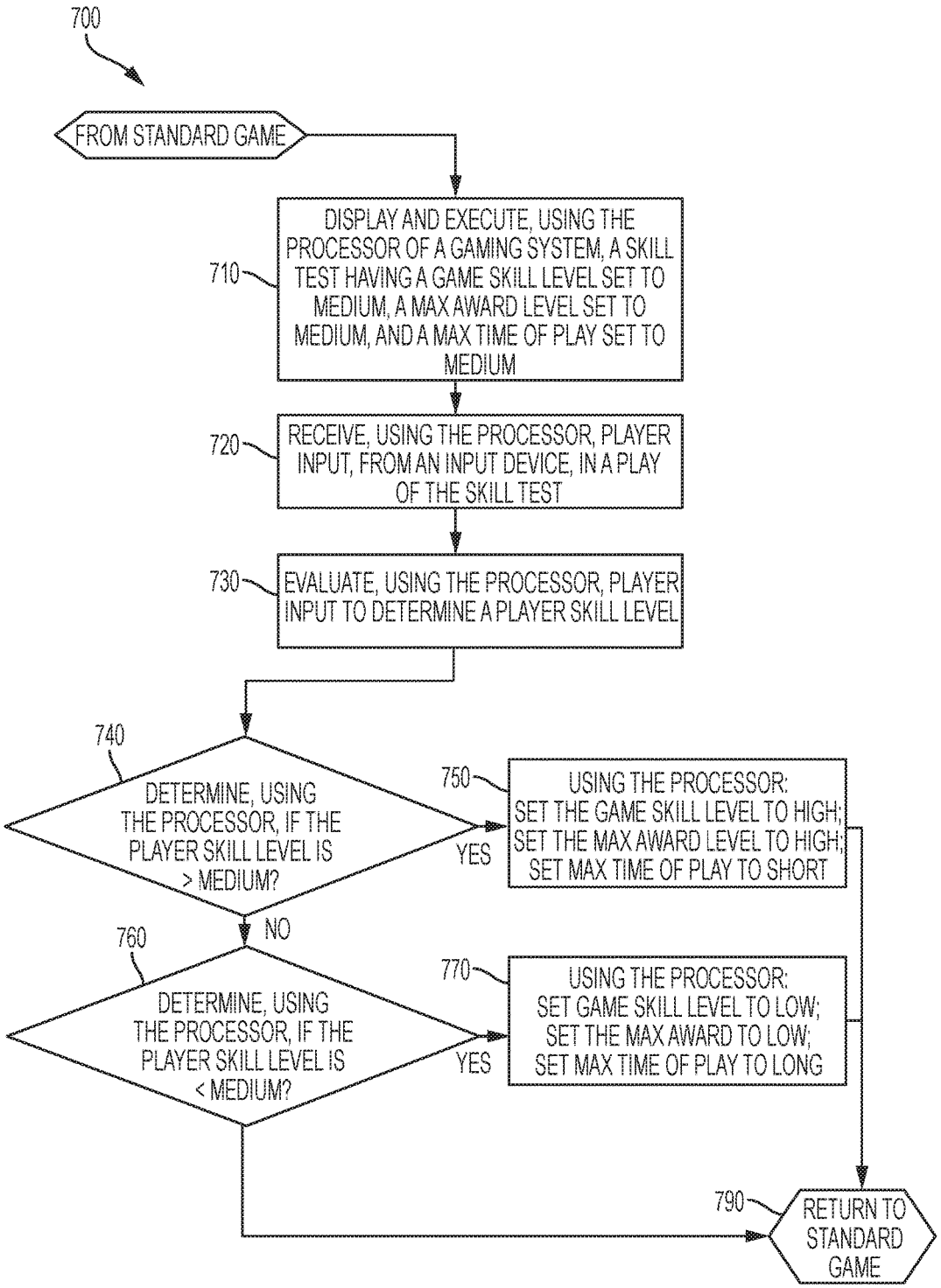
FIG. 7 illustrates a flow chart of one embodiment of skill level determination.

FIG. 7 illustrates a flowchart of an example operation 700 of one embodiment of the gaming system and method having a skill test. A skill test enables the gaming system to determine a player's skill level and adjust one or more parameters of a game. In some embodiments of the gaming system, it may be desirable for the gaming system to evaluate and determine a player's skill level and adjust one or more parameters of the game based on the determined player's skill level. Adjusting the parameters of the game may help prevent highly skilled players from monopolizing a game system and reduce the frustration of low skilled players when a game is difficult. For example, highly skilled players may play a game for extended periods of time and may earn high value awards. This activity may unfairly keep other players from accessing the gaming system and may prevent the gaming system operator from earning reasonable profits from the gaming system. On the other hand, low skilled players may be discouraged when their game skills prevent them from sustaining a play of a game for more than a short period of time and their skills prevent them from obtaining more than low value awards. In one embodiment, the skills test enables the gaming machine to evaluate and determine a player skill level and to adjust one or more parameters of the game to more evenly reward and encourage players of all skill levels.

A gaming system may offer (or the player may request) the skill test 700 at any time during a play of a game in one embodiment. In one embodiment, the gaming system may perform the skill test without the player's knowledge and without the player requesting the skill test. In one such embodiment, as a player plays a base or bonus game, the gaming system evaluates the player's activity during the game to determine an outcome for the skill test. That is, the skill test may be simply the player playing a game. In one embodiment, the skill test may be performed during an initial play of a game or during an initial period of play of a game. By combining the testing with the play of a game, the gaming system becomes more efficient because the gaming system avoids spending additional processing time (and thus power usage) on a separate task that can be performed during another computing task (e.g., during a play of a game). In one embodiment, the gaming system may inform the player about a result of the skill test based on the player's play of the game. In another embodiment, the gaming system may not inform the player about the result of the skill test based on the player's play of the game. It should also be appreciated that the skill test may be performed before or after a play of a game.

As illustrated in block 710, the gaming system may display and execute, using the processor of the gaming system, a skill test. In one embodiment, the initiation of a skill test may include setting initial, or default, game parameters. The initial game parameters are initially set to reflect a medium or average skill level of a player. In one embodiment, the game skill level may be set to medium, the maximum award available to a player may be set to a medium value level, and the maximum time of play for the game may be set to a medium length. It is to be understood that the game parameters and levels discussed are illustrative. The gaming system may set fewer, additional, or other game parameters for the skill test in different embodiments. The various game parameters may be adjusted to other levels during the skill test. In some embodiments, the gaming system sets the default game parameters to low, reflecting skills of novice players. In other embodiments, the default game parameters could be set to a high level. It should be appreciated that the game parameters may include the speed of a play of a game, sensitivity levels of game controls, how accurate a player inputs are in game (e.g., target accuracy), or any other suitable game parameters.

During a play of the skill test, the gaming system receives player input from one or more input devices of the gaming system as illustrated in block 720. In one embodiment, the game may require a player to exhibit a timing skill related to a reaction to a timed display event. During the player's skill test, the gaming system may receive player inputs. The gaming system may evaluate, using the processor, the player's input timing to determine the player skills level. This evaluation is illustrated in block 730 of the skill level test. It should be appreciated that in other embodiments a different skill may be tested and evaluated.

In one embodiment, the gaming system may determine that a player is highly skilled at exhibiting a timing skill related to a reaction to a timed display event in the game. In another embodiment, the gaming system may determine that the player is highly skilled at hitting targets on a display screen with one or more input devices. In one embodiment illustrated in block 740, the gaming system evaluates the player's input to determine if the player's skill level is greater than a medium threshold. For example, if the player's timing reaction is below a certain time period threshold (e.g., less than 2 seconds), the gaming system may determine that the player has a high skill level. Whereas if the player timing reaction is a number greater than the certain time period threshold number, the gaming system may determine that the player does not have a high degree of skill. Similarly, if the game is a target hitting game, the more targets a player hits for a given time period, the greater likelihood that the player possesses a high level of skill. Thus, if a player hits a certain threshold number of targets in block 740, the gaming system may determine that the player possesses a high degree of skill and gaming parameters may need to be adjusted. In one embodiment, the processor may alter the game parameters when the player's skill level is determined. In one embodiment, the processor may alter the parameters during a next play of a game. In some embodiments, the skill test is unrelated to a next game that the player plays. In such an embodiment, if the skill test evaluates similar skills relevant to a play of the next game, the gaming system may adjust game parameters in the play of the next game.

In one embodiment as illustrated by block 750, the gaming system uses the processor to set the game skill level to high. A high skill level may cause one or more game parameters to change to increase the difficulty of the game and become more challenging to a highly skilled player. In one embodiment, a game parameter related to how quickly events occur in a game are altered to make the events occur faster than when the game skill level was set to medium or low. The gaming system may, in one embodiment, set a maximum award level to high. That is, the gaming system may enable the player to win larger awards. In one such embodiment, when the game becomes more difficult to play, the gaming system can provide an incentive for a player to play the more difficult game. The incentive may be an opportunity to use the player's high level of skill to achieve larger awards than may be available when the game skill level is set to medium or low. A set maximum award also assists game designers in designing games that may ensure a level of profit for the gaming system operator (e.g., reducing a gaming systems payout volatility). In one embodiment, the gaming system may set the maximum time period of play to a short period of time. The short period of time reduces the chances of a highly skilled player remaining at a gaming system for extended periods of time without spending money on additional plays of a game. A short time period of play may also provide a greater challenge to highly skilled players, enable the potential award amounts to be set higher, and retains an element of game control highly desirable to game designers.

When the gaming system determines, as illustrated in block 740, that the evaluated player skill level is not greater than a medium level, the gaming system determines if the player skill level is less than a medium level of skill. The gaming system may use similar threshold determinations as discussed above in connection to block 740. However, it should be appreciated that the gaming system may determine the skill level of a player using any suitable test.

Turning to block 760, when the gaming system determines the player skill level is less than medium, the skill test processing moves to block 770. The gaming system, via the processor, may set one or more game parameters to a low level (in a manner similar to the manner discussed above in connection with block 740 and block 750). If the game parameters are set to a low level, the gaming system may make the game easier to play to encourage interest in the game from low skilled players. With game parameters set to a low skill level, the gaming system makes the standard game less difficult and thereby easier for a player to achieve successful game outcomes and continue game play. In one embodiment, the gaming processor may set the award to a maximum award value that is lower than for a game set for a high or medium skill level. By providing a lower maximum award, the gaming system enables the player to win more plays of a game without negatively impacting a gaming system's payout volatility.

In one embodiment, the gaming system may set the maximum time period of play to a long period of time or a time period that is longer than when the game skill level is set to medium or high. The long period of time enables a low skilled player to remain at a gaming system for longer periods of time and learn how to better play a game. Due the player's low skill, the play may end up placing wagers on additional plays of the game when the player finds the game enjoyable and set at appropriate skill level.

In one embodiment, if the player skill level is neither high nor low, the gaming system may determine that the player skill level is medium. In one such embodiment, the gaming system does not need to make any further alterations of the game parameters because, as illustrated block 710, the game parameters were already set to medium.

Once the gaming system updates the game parameters based on one of the determined levels of player skill, the gaming system may return to a game as illustrated in block 790.

In one embodiment, the gaming system may execute the skill test at the beginning of every play of a game. In one embodiment, the gaming system may execute the skill test after a predetermined number of plays of a game. In one embodiment, the gaming system may execute the skill test when the gaming system detects a change in player performance in the standard game. It should be appreciated that the gaming system may execute the skill test at any time before, during or after a play of a game. It should also be appreciated that the skill test can be used at any points in the games described in FIGS. 3A-3B and 4A-4C. Thus, in some embodiments, the gaming system may return to a game as illustrated in block 790. In other embodiments, the gaming system may not return to a game if a game was not already in play when the skill test was executed. That is, in some embodiments, the gaming system may return to a state that enables a player to start a new play of a game or place a wager to start a new play of a game.

It should be appreciated that in some embodiments, the gaming system may include features to detect if a highly skilled player is using the gaming system improperly. For example, a highly skilled player may enter the skill test and may intentionally play the game poorly. In such a scenario, the gaming system may evaluate the player as having skill level that is low, thus the gaming system may set game parameters to in accordance with the low skill level. In one embodiment, if the gaming system detects that the player plays the game with a skill level that is much higher than the low skill level within a predetermine threshold of time, the game system may reset the game parameters to reflect that the player has a medium or high skill level. The gaming system may continuously check for the player's skill level in some embodiments and periodically make adjustments to the player's skill level during a play of a game.

While skill levels were described in FIG. 7 as low, medium, and high, the gaming system may use any suitable number of skill levels to implement the skill test.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

I claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

receive a wager following receipt of a wager input via the input device, the credit balance being decreased by the wager;

receive, from a player, a selection to play between a game in a first game state and a second game state;

when the received selection is to play the game in the first game state:

execute a play of the game in the first game state;

generate an outcome of the first game state; and determine a first non-zero award amount without regard to the outcome of the first game state;

when the received selection is to play the game in the second game state:

execute a play of the game in the second game state;

generate an outcome of the second game state;

evaluate an outcome of the play of the game in the second game state; and determine a second award amount based on the outcome of the second game state;

cause the display device to display the first determined non-zero award amount or the second determined award amount based upon the received selection, the credit balance being increased by either the first determined non-zero award amount or the second determined award amount based upon the received selection; and issue monetary value from the value dispenser based on the credit balance upon receipt of a cash out signal.

2. The gaming system of claim 1, wherein the first game state is a practice game and the second game state is a standard game.

3. The gaming system of claim 1, wherein if the received selection is to play the game in the first game state, the processor evaluates the outcome of the first game state.

4. The gaming system of claim 3, wherein the first game state is a practice game of skill.

5. The gaming system of claim 4, wherein when evaluating the outcome of the first game state, the processor provides feedback comprising how well the player played the practice game of skill.

6. The gaming system of claim 5, wherein the feedback further comprises providing a value of the second award amount the player would have won if the player played the second game state.

7. The gaming system of claim 1, wherein the first non-zero award amount is a predetermined award amount.

8. The gaming system of claim 1, wherein the first non-zero award amount is equal to or higher than the second award amount.

9. The gaming system of claim 1, wherein the first non-zero award amount is lower than the second award amount.

10. The gaming system of claim 1, wherein the first non-zero award amount is independent of how well the player played the game in the first game state.

11. The gaming system of claim 1, wherein the processor provides assistance to the player during the play of the game in the first game state.

12. The gaming system of claim 1, wherein when determining the second award amount, the processor determines the second award amount based on how well the player played the game in the second game state.

13. The gaming system of claim 1, wherein the first non-zero award is based on a difference between a theoretical average payout of the game and an observed average payout of the game.

14. The gaming system of claim 13, wherein the first game state is a practice bonus game and the processor further executes another play of the practice bonus game if the outcome of the first game state is determined to be a bad outcome.

15. The gaming system of claim 1, wherein a first portion of the first non-zero award is independent of how well the player played the game in the first game state and a second portion of the first non-zero award depends on how well the player played the game in the first game state.

16. The gaming system of claim 1, wherein the processor receives a request to execute a skill test of the player in a play of the game of the second game state.

17. The gaming system of claim 16, wherein the processor alters at least one aspect of the second game state based on the outcome of the skill test.

18. The gaming system of claim 1, wherein the processor alters at least one aspect of the first game state based on an evaluation of the player in a prior play of the game.

19. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

receiving, by the processor, a selection from a player to play between a game in a first game state and a second game state;

when the received selection is to play the game in the first game state:

executing, with the processor, a play of the game in the first game state, generating, with the processor, an outcome of the first game state, and determining, with the processor, a first non-zero award amount without regard to the outcome of the first game state;

when the received selection is to play the game in the second game state:

executing, with the processor, a play of the game in the second game state, generating, with the processor, an outcome of the second game state, evaluating, with the processor, an outcome of the play of the game in the second game state, and determining, with the processor, a second award amount based on the outcome of the second game state;

displaying, on a display device, the first determined non-zero award amount or the second determined award amount based upon the received selection;

increasing, with the processor, the credit balance by the first determined non-zero award amount or the second determined award amount based upon the received selection; and issuing monetary value, with a value dispenser, based on the credit balance upon receipt of a cash out signal.

20. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager;

receive, from a player, a selection to play between a game in a first game state a second game state;

when the received selection is to play the game in the first game state:

execute a play of the game in the first game state, generate an outcome of the first game state, and determine a first non-zero award amount without regard to the outcome of the first game state;

when the received selection is to play the game in the second game state:

execute a play of the game in the second game state, generate an outcome of the second game state, evaluate an outcome of the play of the game in the second state, and determine a second award amount based on the outcome of the second game state;

cause a display device to display the first determined non-zero award amount or the second determined award amount based upon the received selection, the credit balance being increased by either the first determined non-zero award amount or the second determined award amount based upon the received selection; and issue monetary value from a value dispenser based on the credit balance upon receipt of a cash out signal.

* * * * *